US012245737B2

(12) United States Patent
Cho et al.

(10) Patent No.: US 12,245,737 B2
(45) Date of Patent: Mar. 11, 2025

(54) CLEANING DEVICE INCLUDING VACUUM CLEANER AND DOCKING STATION AND CONTROL METHOD THEREOF

(71) Applicant: Samsung Electronics Co., Ltd., Suwon-si (KR)

(72) Inventors: Yoonkyung Cho, Suwon-si (KR); Sanghyuk Park, Suwon-si (KR); Jusang Lee, Suwon-si (KR); Daehyung Kim, Suwon-si (KR); Jaehyun Yun, Suwon-si (KR); Gihyeong Lee, Suwon-si (KR); Ahyoung Lee, Suwon-si (KR); Jaeshik Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 527 days.

(21) Appl. No.: 17/532,565

(22) Filed: Nov. 22, 2021

(65) Prior Publication Data

US 2022/0160201 A1 May 26, 2022

Related U.S. Application Data

(63) Continuation of application No. PCT/KR2021/016681, filed on Nov. 15, 2021.

(30) Foreign Application Priority Data

Nov. 24, 2020 (KR) ..... 10-2020-0159378

(51) Int. Cl.
*A47L 9/28* (2006.01)
*A47L 9/10* (2006.01)

(52) U.S. Cl.
CPC ..... *A47L 9/2873* (2013.01); *A47L 9/106* (2013.01); *A47L 9/2836* (2013.01); *A47L 9/2842* (2013.01); *A47L 2201/024* (2013.01)

(58) Field of Classification Search
CPC ..... A47L 9/2873; A47L 9/106; A47L 9/2842; A47L 2201/024; A47L 9/0063;
(Continued)

(56) References Cited

U.S. PATENT DOCUMENTS 7,779,504 B2 8/2010 Lee et al.
10,405,718 B2 9/2019 Morin et al.
(Continued)

FOREIGN PATENT DOCUMENTS

DE 102014111868 A1 * 2/2016 ..... A47L 9/10
JP 2017-189453 A 10/2017
(Continued)

OTHER PUBLICATIONS

Kornberger M, DE-102014111868-A1, Feb. 25, 2016; translation (Year: 2016).*
(Continued)

*Primary Examiner* — Bryan R Muller
(74) *Attorney, Agent, or Firm* — Jefferson IP Law, LLP

(57) ABSTRACT

A cleaning device is provided. The cleaning device includes a vacuum cleaner which includes a dust collecting bin and a docking station to which the vacuum cleaner is coupled, wherein the docking station includes a charger configured to be electrically connected to a charging terminal of the vacuum cleaner in response to the vacuum cleaner being coupled to the docking station, a door driver configured to open or close a dust collecting bin door disposed at a lower portion of the dust collecting bin, a suction device configured to move air from the dust collecting bin into the docking station, a collector configured to collect foreign matter that moves together with the air due to driving the suction device, and a controller configured to control the door driver to open the dust collecting bin door in response to the charging terminal of the vacuum cleaner being elec-
(Continued)

trically connected to the charger, configured to control the suction device to supply a suctioning air flow to the dust collecting bin and perform a discharge operation in response to the dust collecting bin door being opened, and configured to control the door driver to close the dust collecting bin door in response to an end of the discharge operation.

20 Claims, 25 Drawing Sheets

(58) Field of Classification Search
CPC . A47L 9/20; A47L 9/28; A47L 9/2831; A47L 9/281; A47L 2201/022; A47L 9/2836
USPC ..... 15/300, 100
See application file for complete search history.

(56) References Cited

U.S. PATENT DOCUMENTS

| | | | | |
|---|---|---|---|---|
| 2016/0183752 | A1* | 6/2016 | Morin | A47L 9/1625 15/340.1 |
| 2018/0177358 | A1 | 6/2018 | Conrad | |
| 2020/0029765 | A1 | 1/2020 | Morin et al. | |
| 2020/0069141 | A1* | 3/2020 | Cargill | A47L 9/106 |
| 2020/0138255 | A1 | 5/2020 | Sato et al. | |
| 2020/0315419 | A1 | 10/2020 | Sato et al. | |
| 2020/0345196 | A1 | 11/2020 | Innes et al. | |
| 2023/0060474 | A1* | 3/2023 | Kim | A47L 9/2873 |

FOREIGN PATENT DOCUMENTS

| | | | |
|---|---|---|---|
| JP | 2019-005068 | A | 1/2019 |
| JP | 2020-036899 | A | 3/2020 |
| KR | 10-0411432 | B1 | 12/2003 |
| KR | 10-0849554 | B1 | 7/2008 |
| KR | 10-2016-0137494 | A | 11/2016 |
| KR | 10-1836975 | B1 | 3/2018 |
| KR | 10-2020-0073975 | A | 6/2020 |

OTHER PUBLICATIONS

International Search Report dated Mar. 8, 2022, issued in International Patent Application Serial No. PCT/KR2021/016681.
European Search Report dated Jan. 2, 2024, issued in European Application No. 21898462.3.
European Communication under Rule 71(3) EPC dated Sep. 19, 2024, issued in European Application No. 21898462.3.

* cited by examiner

FIG. 13

| STATE | | DETAILS OF CONTROL |
|---|---|---|
| VACUUM CLEANER IS COUPLED | NO CONDITION (PERFORM CONTROL IN RESPONSE TO COUPLING OF VACUUM CLEANER) | PERFORM DISCHARGE OPERATION + PERFORM CHARGING |
| | DISCHARGE COMMAND IS INPUT | |
| | CAPACITY LEVEL OF DUST COLLECTING BIN IS SET VALUE OR MORE | |
| | DISCHARGE COMMAND IS NOT INPUT + CAPACITY LEVEL OF DUST COLLECTING BIN IS LESS THAN SET VALUE | DO NOT PERFORM DISCHARGE OPERATION + PERFORM CHARGING |
| VACUUM CLEANER IS NOT COUPLED (SEPARATED) | | DO NOT PERFORM DISCHARGE OPERATION + DO NOT PERFORM CHARGING |

CLEANING DEVICE INCLUDING VACUUM CLEANER AND DOCKING STATION AND CONTROL METHOD THEREOF

CROSS-REFERENCE TO RELATED APPLICATION(S)

This application is a continuation application, claiming priority under § 365(c), of an International application No. PCT/KR2021/016681, filed on Nov. 15, 2021, which is based on and claims the benefit of a Korean patent application number 10-2020-0159378, filed on Nov. 24, 2020, in the Korean Intellectual Property Office, the disclosure of which is incorporated by reference herein in its entirety.

TECHNICAL FIELD

The disclosure relates to a cleaning device including a vacuum cleaner and a docking station.

BACKGROUND ART

Generally, a vacuum cleaner is a device that includes a fan motor configured to generate a suction force and suctions foreign matter, such as dust, together with air using the suction force generated by the fan motor and separates and collects the suctioned foreign matter from the air to perform cleaning.

To this end, the vacuum cleaner includes a dust collecting bin configured to collect foreign matter, and a user should periodically remove the collected foreign matter from the dust collecting bin. However, when the user removes the foreign matter from the dust collecting bin, the foreign matter may scatter again and increase the indoor dust level.

The above information is presented as background information only to assist with an understanding of the disclosure. No determination has been made, and no assertion is made, as to whether any of the above might be applicable as prior art with regard to the disclosure.

DISCLOSURE

Technical Problem

Aspects of the disclosure are to address at least the above-mentioned problems and/or disadvantages and to provide at least the advantages described below. Accordingly, an aspect of the disclosure is to provide a cleaning device that includes a vacuum cleaner and a docking station and is capable of, when the vacuum cleaner is docked at the docking station, supplying a suctioning air flow to a dust collecting bin of the vacuum cleaner to discharge foreign matter from inside the dust collecting bin.

Additional aspects will be set forth in part in the description which follows and, in part, will be apparent from the description, or may be learned by practice of the presented embodiments.

Technical Solution

In accordance with an aspect of the disclosure, a cleaning device is provided. The cleaning device includes a vacuum cleaner which includes a dust collecting bin and a docking station capable of connecting with the vacuum cleaner. The docking station includes a charger configured to be electrically connected to a charging terminal of the vacuum cleaner in response to the vacuum cleaner being coupled to the docking station, a door driver configured to open or close a dust collecting bin door disposed at a lower portion of the dust collecting bin, a suction device configured to move air from the dust collecting bin into the docking station, a collector configured to collect foreign matter such that the foreign matter moves with the air due to driving the suction device, and a controller configured to control the door driver to open the dust collecting bin door in response to the charging terminal of the vacuum cleaner being electrically connected to the charger, control the suction device to supply a suctioning air flow to the dust collecting bin, perform a discharge operation in response to the dust collecting bin door being opened, and control the door driver to close the dust collecting bin door in response to an end of the discharge operation.

The controller may control the suction device to periodically change a suction force while performing the discharge operation.

The controller may control the suction device to periodically repeat being turned on and off.

The controller may control the suction device to periodically change a rotational speed.

The docking station may further include a communication interface, and the controller may control the communication interface to transmit to the vacuum cleaner a control command for a cleaner suction device to operate while the discharge operation is performed.

The controller may control the communication interface to transmit to the vacuum cleaner a control command for the cleaner suction device to operate in response to a predetermined amount of time elapsing from a start of the discharge operation.

The controller may control the communication interface to transmit to the vacuum cleaner a control command for the cleaner suction device to continuously operate for a predetermined amount of time before an end of the discharge operation.

The controller may control the suction device to continuously operate while performing the discharge operation and may control the communication interface to transmit to the vacuum cleaner a control command for a suction force of the cleaner suction device to be periodically changed while the suction device continuously operates.

The controller may control the suction device to periodically change a suction force while performing the discharge operation and may control the communication interface to transmit to the vacuum cleaner a control command for the cleaner suction device to continuously operate while the suction device periodically changes the suction force.

The controller may, while controlling the suction device so that the suction device and the cleaner suction device alternately operate while the discharge operation is performed, control the communication interface to transmit a control command to the vacuum cleaner.

The docking station may further include a dust collecting bin sensor configured to detect a capacity level of the dust collecting bin, and the controller may control the suction device to start the discharge operation in response to the capacity level of the dust collecting bin being determined as a first set value or more based on an output of the dust collecting bin sensor in a state in which the vacuum cleaner is coupled to the docking station.

The controller may control the suction device to end the discharge operation in response to the capacity level of the dust collecting bin being determined as less than a second set value based on an output of the dust collecting bin sensor.

The controller may control the suction device to start the discharge operation in response to an input for starting the discharge operation being received from a terminal through the communication interface in a state in which the vacuum cleaner is coupled to the docking station.

The dust collecting bin may include a fixing member configured to, in response to being pressed by an external force, allow the dust collecting bin door to be detached from the dust collecting bin so that the dust collecting bin is open, the docking station may include an opening member configured to press the fixing member to make the dust collecting bin open according to a user input, and the controller may control the suction device to start the discharge operation in response to the opening member being disposed at a position pressing the fixing member in a state in which the vacuum cleaner is coupled to the docking station.

In accordance with another aspect of the disclosure, a control method of a cleaning device is provided. The cleaning device includes a vacuum cleaner which includes a dust collecting bin and a docking station which includes a charger configured to be electrically connected to a charging terminal of the vacuum cleaner in response to the vacuum cleaner being coupled to the docking station and a suction device configured to move air from the dust collecting bin into the docking station, includes opening a dust collecting bin door disposed at a lower portion of the dust collecting bin in response to the charging terminal of the vacuum cleaner being electrically connected to the charger, controlling the suction device to supply a suctioning air flow to the dust collecting bin and perform a discharge operation in response to the dust collecting bin door being opened, and closing the dust collecting bin door in response to an end of the discharge operation.

The controlling of the suction device may include controlling the suction device to periodically change a suction force while performing the discharge operation.

The controlling of the suction device to periodically change the suction force may include controlling the suction device to periodically repeat being turned on and off.

The controlling of the suction device to periodically change the suction force may include controlling the suction device to periodically change a rotational speed.

The docking station may further include a communication interface, and the control method may further include controlling the communication interface to transmit to the vacuum cleaner a control command for a cleaner suction device to operate while the discharge operation is performed.

The controlling of the communication interface may include controlling the communication interface to transmit to the vacuum cleaner a control command for the cleaner suction device to operate in response to a predetermined amount of time elapsing from a start of the discharge operation.

The controlling of the communication interface may include controlling the communication interface to transmit to the vacuum cleaner a control command for the cleaner suction device to continuously operate for a predetermined amount of time before an end of the discharge operation.

The controlling of the suction device may include controlling the suction device to continuously operate while performing the discharge operation, and the controlling of the communication interface may include controlling the communication interface to transmit to the vacuum cleaner a control command for a suction force of the cleaner suction device to be periodically changed while the suction device continuously operates.

The controlling of the suction device may include controlling the suction device to periodically change a suction force while performing the discharge operation, and the controlling of the communication interface may include controlling the communication interface to transmit to the vacuum cleaner a control command for the cleaner suction device to continuously operate while the suction device periodically changes the suction force.

The controlling of the suction device and the controlling of the communication interface may include, while controlling the suction device so that the suction device and the cleaner suction device alternately operate while the discharge operation is performed, controlling the communication interface to transmit a control command to the vacuum cleaner.

The docking station may further include a dust collecting bin sensor configured to detect a capacity level of the dust collecting bin, and the controlling of the suction device may include controlling the suction device to start the discharge operation in response to the capacity level of the dust collecting bin being determined as a first set value or more based on an output of the dust collecting bin sensor in a state in which the vacuum cleaner is coupled to the docking station.

The controlling of the suction device may include controlling the suction device to end the discharge operation in response to the capacity level of the dust collecting bin being determined as less than a second set value based on an output of the dust collecting bin sensor.

The controlling of the suction device may include controlling the suction device to start the discharge operation in response to a user input for starting the discharge operation being received from a user terminal through the communication interface in a state in which the vacuum cleaner is coupled to the docking station.

The dust collecting bin may include a fixing member configured to, in response to being pressed by an external force, allow the dust collecting bin door to be detached from the dust collecting bin so that the dust collecting bin is open, the docking station may include an opening member configured to press the fixing member to make the dust collecting bin open according to a user input, and the controlling of the suction device may include controlling the suction device to start the discharge operation in response to the opening member being disposed at a position pressing the fixing member in a state in which the vacuum cleaner is coupled to the docking station.

The docking station may further include a door driver configured to open or close the dust collecting bin door disposed at the lower portion of the dust collecting bin, and the opening of the dust collecting bin door may include controlling the door driver to open the dust collecting bin door.

The closing of the dust collecting bin door may include controlling the door driver to close the dust collecting bin door.

Advantageous Effects

Using a cleaning device according to an embodiment, not only charging a battery of a vacuum cleaner but also automatically removing foreign matter collected in a dust collecting bin of the vacuum cleaner can be performed through a docking station of the vacuum cleaner.

In particular, by providing irregular suctioning air flows to the dust collecting bin of the vacuum cleaner in a state in which the vacuum cleaner is docked at the docking station, the foreign matter collected inside the dust collecting bin can be effectively removed.

Other aspects, advantages, and salient features of the disclosure will become apparent to those skilled in the art from the following detailed description, which, taken in conjunction with the annexed drawings, discloses various embodiments of the disclosure.

DESCRIPTION OF DRAWINGS

The above and other aspects, features, and advantages of certain embodiments of the disclosure will be more apparent from the following description taken in conjunction with the accompanying drawings, in which:

FIG. 13 is a view for describing a case in which the cleaning device performs control according to an external state according to an embodiment of the disclosure;

Throughout the drawings, it should be noted that like reference numbers are used to depict the same or similar elements, features, and structures.

MODES OF THE INVENTION

Figure 1:
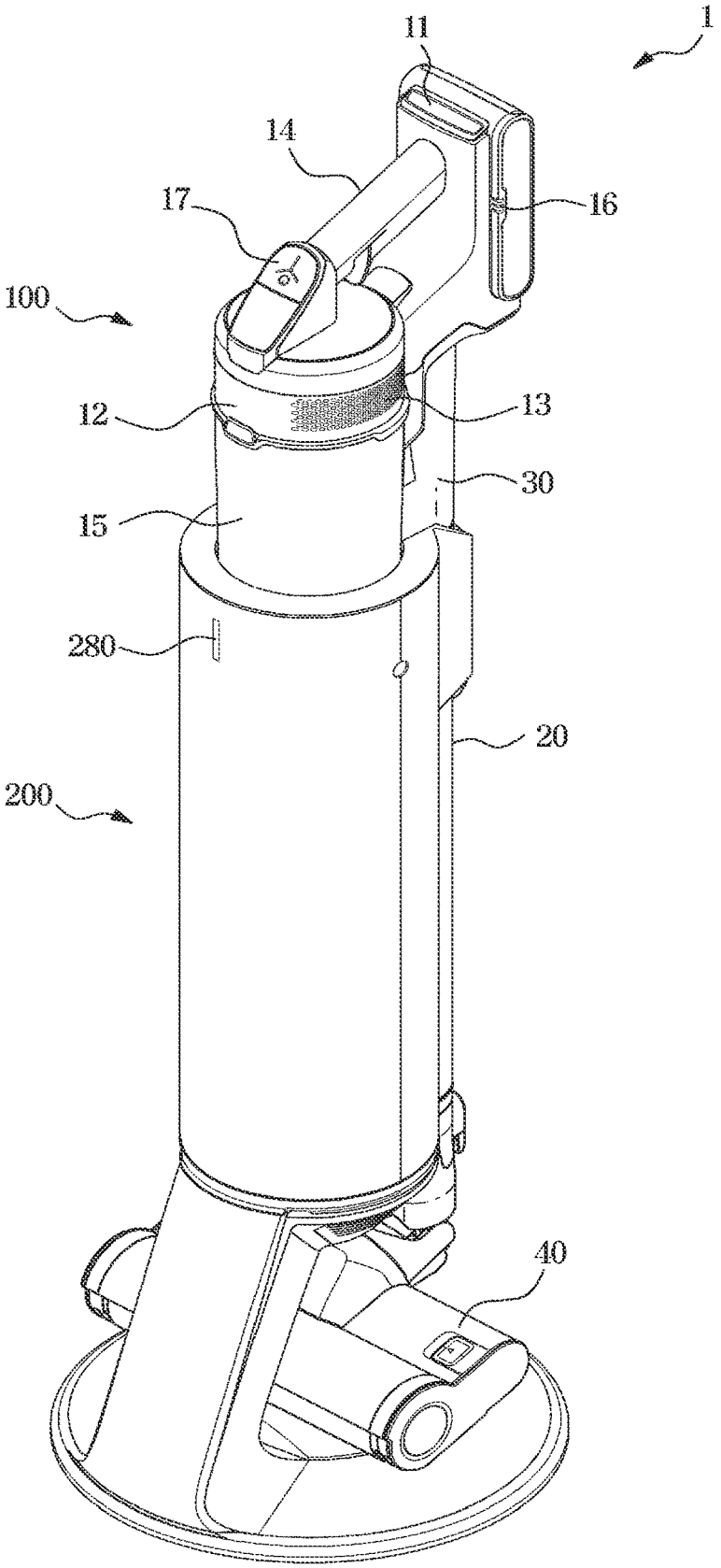
FIG. 1 is an exterior view of a cleaning device according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Throughout the application, when a certain part is described as being "connected" to another part, both a case in which the certain part is indirectly connected to the other part as well as a case in which the certain part is directly connected to the other part are included therein, and the indirect connection includes a connection via a wireless network.

Terms used herein are for describing the embodiments and are not intended to limit and/or restrict the disclosure. A singular expression includes a plural expression unless context clearly indicates otherwise. In the application, terms such as "include" or "have" should be understood as designating that features, number, steps, operations, elements, parts, or combinations thereof are present and not as precluding the possibility of the presence or addition of one or more other features, numbers, steps, operations, elements, parts, or combinations thereof in advance.

Terms including ordinals such as first and second may be used herein to describe various elements, but the elements are not limited by the terms. The terms are only used for the purpose of distinguishing one element from another element. For example, a first element may be referred to as a second element while not departing from the scope of the disclosure, and likewise, a second element may also be referred to as a first element.

Terms such as "part," "-er/or," "block," "member," and "module" may refer to a unit of processing at least one function or operation. For example, the terms may refer to at least one hardware such as a field programmable gate array (FPGA) and an application-specific integrated circuit (ASIC), at least one software stored in a memory, or at least one process processed by a processor.

A reference numeral assigned to each step is used to identify each step and is not intended to represent an order of the steps. The steps may be performed in a different order from the stated order unless context clearly describes a specific order.

Hereinafter, embodiments according to the disclosure will be described in detail with reference to the accompanying drawings.

Figure 2:
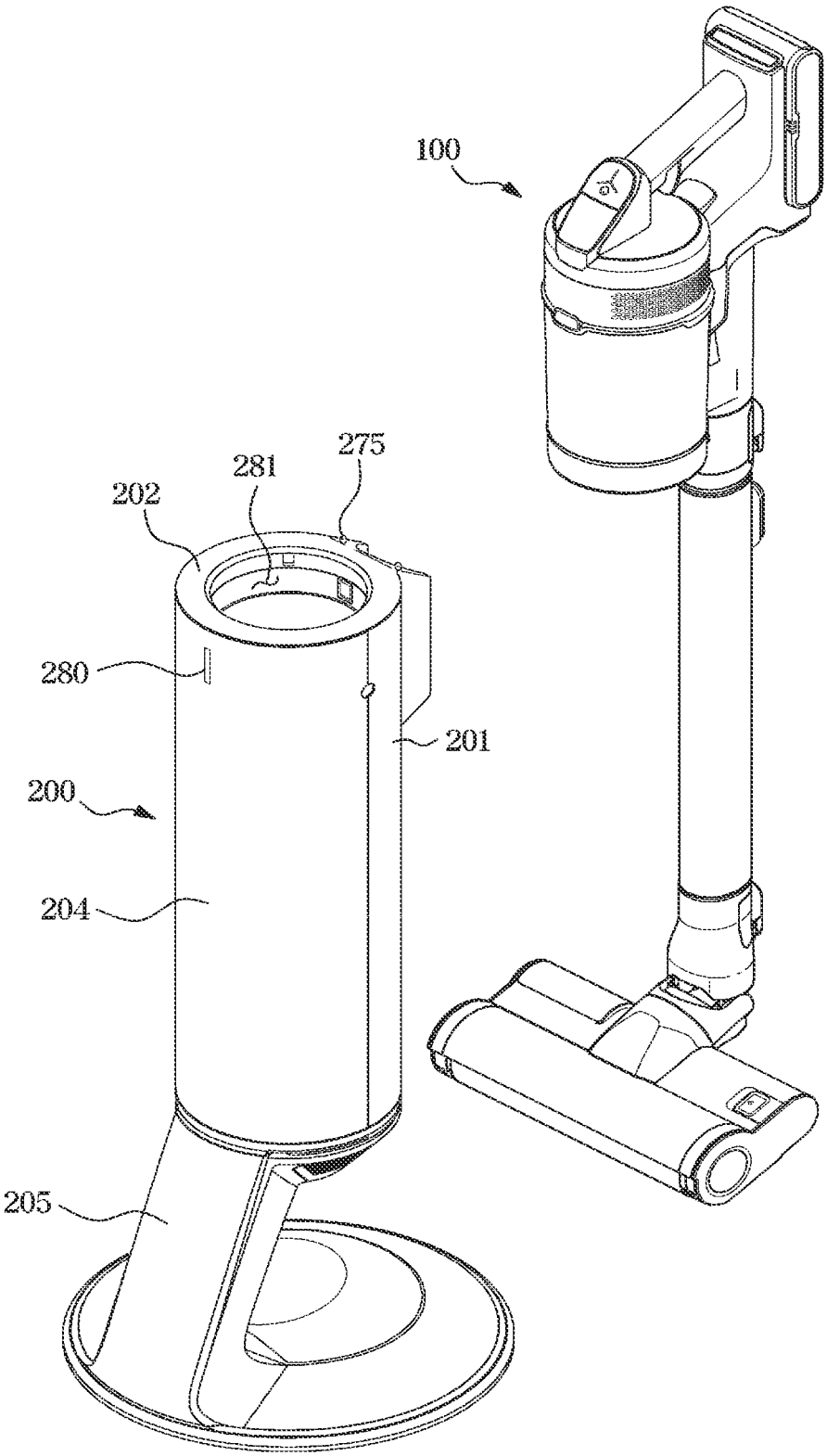
FIG. 2 is a view illustrating a state in which a vacuum cleaner is separated from a docking station according to an embodiment of the disclosure.

FIG. 1 is an exterior view of a cleaning device according to an embodiment of the disclosure. FIG. 2 is a view illustrating a state in which a vacuum cleaner is separated from a docking station according to an embodiment of the disclosure.

Referring to FIG. 1, a cleaning device 1 according to an embodiment may include a vacuum cleaner 100 which includes a dust collecting bin 15 configured to accommodate suctioned foreign matter and a docking station 200 which is connected to the vacuum cleaner 100 and able to remove the foreign matter from the dust collecting bin 15.

The vacuum cleaner 100 according to an embodiment may include a main body 11, an extension tube 20 separably coupled to the main body 11, a suction unit 40 separably coupled to the extension tube 20, and the dust collecting bin 15 separably coupled to the main body 11.

The main body 11 may include a first suction device (a suction motor) configured to generate a suction force necessary to suction foreign matter on a surface to be cleaned and the dust collecting bin 15 configured to accommodate the foreign matter suctioned from the surface to be cleaned.

The dust collecting bin 15 may be disposed more upstream of an air flow than the first suction device and configured to filter and collect dust or dirt in the air entering through the suction unit 40. The dust collecting bin 15 may be provided to be separable from the main body 11.

Also, the vacuum cleaner 100 may include a filter housing 12, depending on the embodiment. The filter housing 12 may be provided in a substantially donut shape to accommodate a filter (not illustrated) therein. The type of filter is not limited, but for example, a high-efficiency particulate air (HEPA) filter may be disposed inside the filter housing 12. The filter may filter particulate matter of 2.5 μm or less in diameter that is not filtered in the dust collecting bin 15. The filter housing 12 may include an outlet 13 so that air that has passed through the filter is discharged to the outside of the vacuum cleaner 100.

The main body 11 may include a handle 14 that is configured to be gripped by a user to manipulate the vacuum cleaner 100. The user may hold the handle 14 and move the vacuum cleaner 100 back and forth.

The main body 11 may include a battery 16 configured to provide the vacuum cleaner 100 with a driving force. The battery 16 may be separably mounted on the main body 11 of the vacuum cleaner 100.

The main body 11 may include an operation panel 17. The user may manipulate a power button or the like provided on the operation panel 17 to turn on/off the vacuum cleaner 100 or adjust a suction strength.

The main body 11 may include a dust collection guide 30 configured to connect the extension tube 20 and the suction unit 40 to the dust collecting bin 15 and guide foreign matter to the dust collecting bin 15.

The dust collection guide 30 may be coupled to the extension tube 20 while guiding foreign matter to the dust collecting bin 15 as described above. Also, the dust collection guide 30 may be provided to be directly coupled to the suction unit 40 other than the extension tube 20 or coupled to other configurations such as an auxiliary suction unit.

Accordingly, the user may couple various attachment configurations to the dust collection guide 30 depending on the cleaning situation in order to increase convenience in cleaning Hereinafter, the case in which one end of the extension tube 20 is coupled to the dust collection guide 30 and the suction unit 40 is connected to the other end of the extension tube 20 will be described as an example.

Referring to FIG. 2, the docking station 200 according to an embodiment may include a main body 201 and a docking housing 202 provided to allow the vacuum cleaner 100 to be coupled (docked). The docking housing 202 may include a seating portion 281 on which the dust collecting bin 15 is seated. That is, the vacuum cleaner 100 may be coupled to the docking station 200 as the dust collecting bin 15 is coupled to the seating portion 281.

The dust collecting bin 15 of the vacuum cleaner 100 may be removably coupled to the seating portion 281 such that the vacuum cleaner 100 is mounted on the docking station 200. The docking station 200 may include a support member 205 disposed at a lower portion of the main body 201 so that the suction unit 40 is spaced apart from the floor and the dust collecting bin 15 may be coupled to the seating portion 281. The support member 205 may be connected to one side surface of the main body 201 and extend in a vertical direction to allow the main body 201 to be spaced apart from the floor. In this way, since the suction unit 40 is disposed in a separation space between the main body 201 and the floor, the dust collecting bin 15 may be coupled to the seating portion 281.

Also, the docking station 200 may include a panel 204 which is disposed on a front surface of the main body 201 and provided to be separable from the main body 201. The panel 204 may also be disposed on a side surface or a rear surface of the main body 201, instead of being disposed on the front surface thereof, and provided to be separable from the main body 201.

As the panel 204 is separated from the main body 201, the user may open a collector, which will be described below, and may easily replace a dust bag of the collector.

Also, the docking station 200 may further include a display 280 provided on a front surface to display an operational state of the docking station 200. For example, as illustrated in FIG. 2, the display 280 may correspond to a light emitting diode (LED) panel configured to irradiate light to communicate a status or state within the cleaning device 1. However, the position and type of the display 280 are not limited thereto and may vary as long as the display 280 is able to display the operational state.

As illustrated in FIG. 1, the docking station 200 according to an embodiment may be configured so that the entire vacuum cleaner 100 is removably coupled thereto instead of only the dust collecting bin 15 being coupled thereto.

Here, the docking station 200 may change a suctioning air flow supplied to the dust collecting bin 15 of the vacuum cleaner 100 to perform a discharge operation discharging the foreign matter from inside the dust collecting bin 15.

Specifically, depending on the embodiment, when the vacuum cleaner 100 is coupled to the docking station 200, the docking station 200 may control a second suction device (a suction motor) to perform the discharge operation. Here, the docking station 200 controls a suction force of the second suction device to be changed periodically to provide irregular suctioning air flows to the dust collecting bin 15, thus allowing the foreign matter to be discharged more efficiently.

Also, depending on the embodiment, when the vacuum cleaner 100 is coupled to the docking station 200, the docking station 200 may perform communication with the vacuum cleaner 100 and simultaneously control the first suction device (suction motor) of the vacuum cleaner 100 and the second suction device (suction motor) of the docking station 200 to allow the foreign matter to be more efficiently discharged from the dust collecting bin 15.

The discharge operation discharging the foreign matter from inside the dust collecting bin 15 will be described in more detail below.

Therefore, without a need to perform an operation of separating the dust collecting bin 15 from the vacuum cleaner 100, the entire vacuum cleaner 100 having the dust collecting bin 15 may be docked or mounted thereon at the docking station 200. That is, the docking station 200 may automatically discharge the foreign matter from inside the dust collecting bin 15 while serving as a stand of the vacuum cleaner 100.

Further, the docking station 200 may charge the battery 16 of the vacuum cleaner 100 while the vacuum cleaner 100 is coupled to the docking station 200. Specifically, the docking station 200 may include a charging terminal 275 provided at one side of the docking housing 202. Here, the charging terminal 275 may come into contact with a charging terminal of the vacuum cleaner 100 when the vacuum cleaner 100 is coupled to the docking station 200. Therefore, the docking station 200 may supply power through the charging terminal 275 to charge the battery 16 of the vacuum cleaner 100. Here, the docking station 200 may determine that the vacuum cleaner 100 is coupled to the docking station 200 when the charging terminal of the vacuum cleaner 100 is electrically connected to the charging terminal 275 of the docking station 200. However, the position of the charging terminal 275 is not limited to the above example and may vary as long as the position allows the charging terminal 275 to come into contact with the charging terminal of the vacuum cleaner 100 when the vacuum cleaner 100 is coupled to the docking station 200. Charging the battery 16 of the vacuum cleaner 100 will be described in more detail below.

Figure 3:
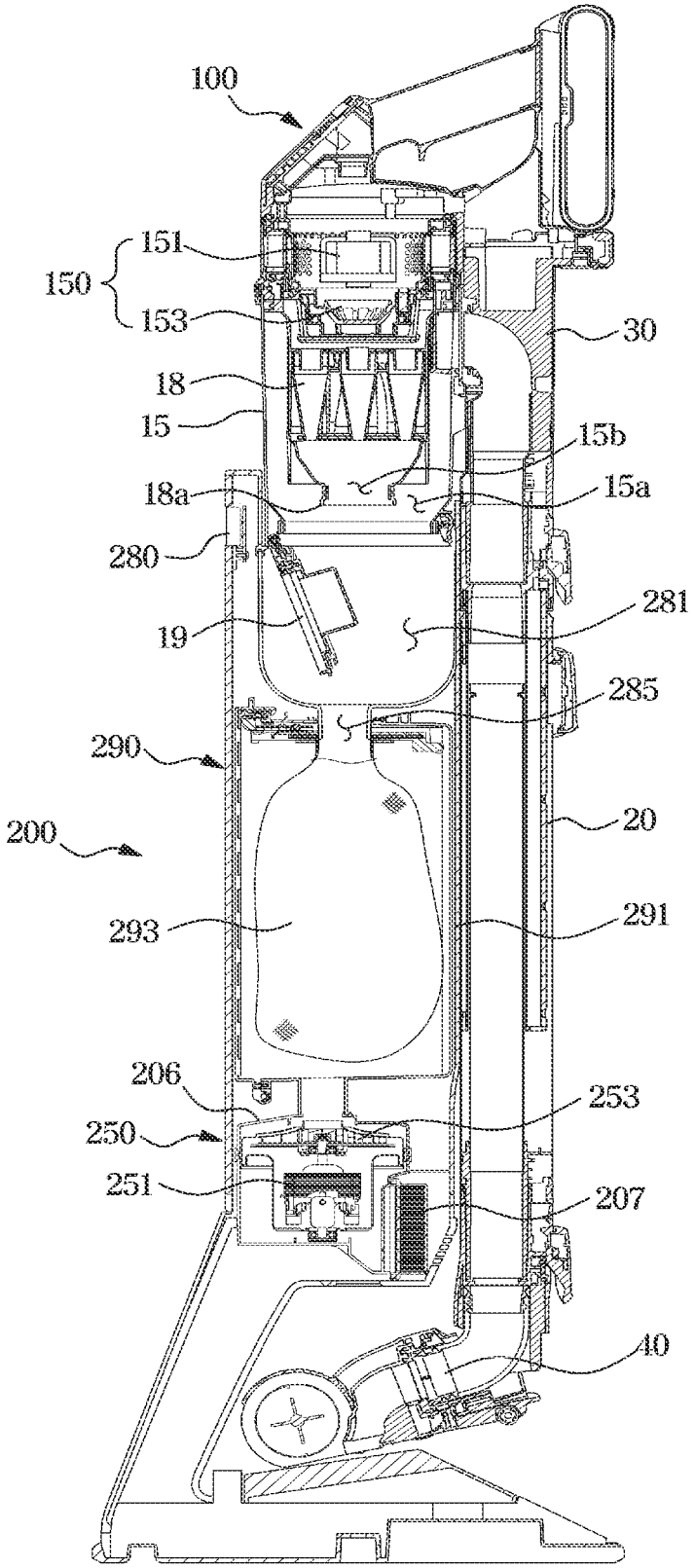
FIG. 3 is a lateral cross-sectional view of the cleaning device according to an embodiment of the disclosure.
Figure 4:
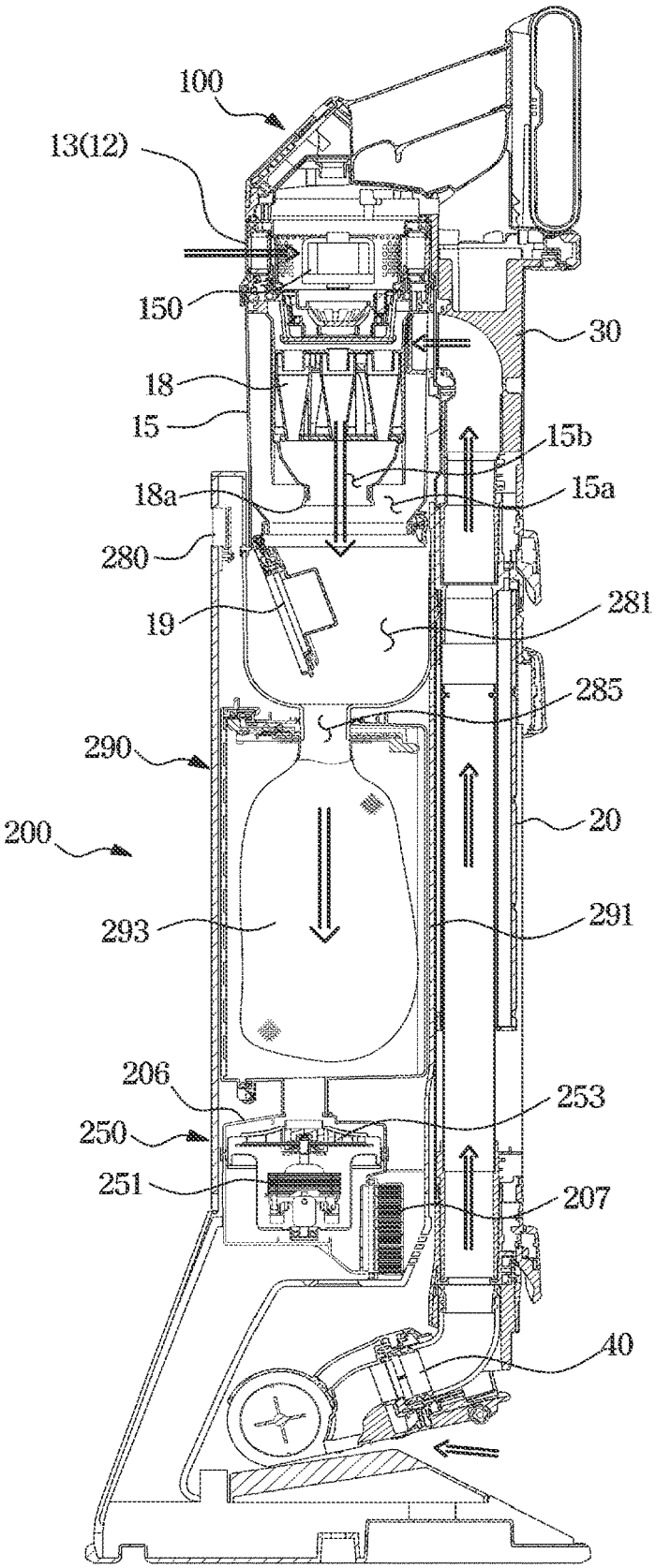
FIG. 4 is a view illustrating an air flow inside the cleaning device in a case in which the cleaning device performs a discharge operation according to an embodiment of the disclosure.
Figure 5:
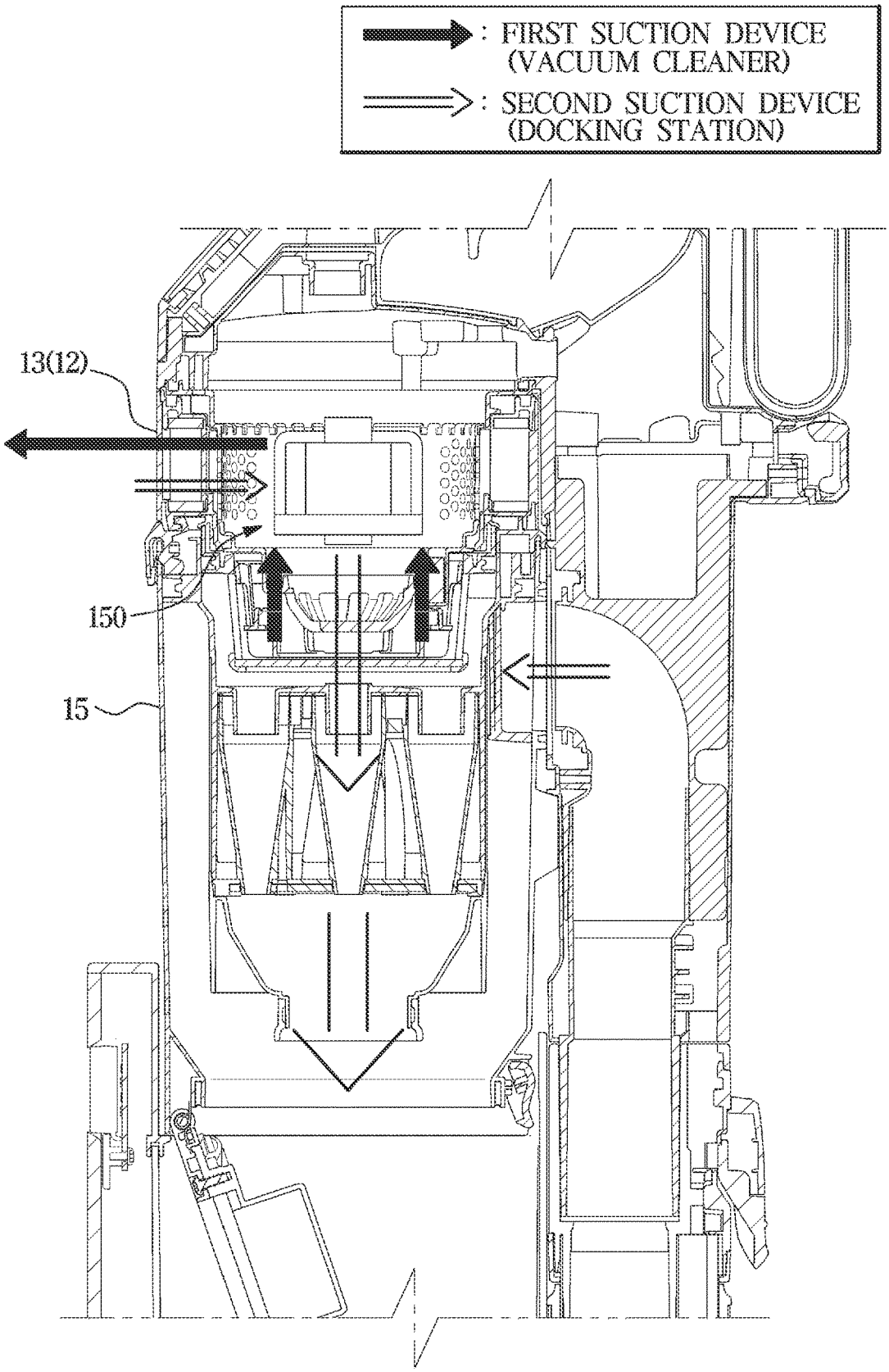
FIG. 5 is a view illustrating an air flow according to an operation of a first suction device during the discharge operation of the cleaning device according to an embodiment of the disclosure.

FIG. 3 is a lateral cross-sectional view of the cleaning device 1 according to an embodiment of the disclosure. FIG. 4 is a view illustrating an air flow inside the cleaning device in a case in which the cleaning device 1 performs the discharge operation according to an embodiment of the disclosure. FIG. 5 is a view illustrating an air flow according to an operation of the first suction device during the discharge operation of the cleaning device 1 according to an embodiment of the disclosure.

Referring to FIG. 3, the docking station 200 may include a second suction device (suction device) 250 to discharge foreign matter collected in the dust collecting bin 15 from the dust collecting bin 15. The suction device 250 may be disposed inside the main body 201 and includes a second suction fan 253 configured to move air and a second motor 251 configured to rotate the second suction fan 253.

The docking station 200 may include a collector 290 in which the foreign matter discharged from the dust collecting bin 15 is collected. The collector 290 may be disposed inside the main body 201. The collector 290 may be disposed more upstream of an air flow than the suction device 250.

The docking station 200 may include a suction flow path 285 which includes one end connected to the dust collecting bin 15 and the other end connected to the suction device 250 and through which air moving due to the suction device 250 flows.

Specifically, the suction flow path 285 may connect the docking housing 202 and the suction device 250. Here, the collector 290 may be provided on the suction flow path 285.

That is, the suction flow path 285 connects the docking housing 202 and the collector 290 to allow the foreign matter discharged from the dust collecting bin 15 to be suctioned into the collector 290 through the docking housing 202.

The docking housing 202 may include the seating portion 281 which communicates with the suction flow path 285 and on which the dust collecting bin 15 is seated.

The seating portion 281 is a space of the docking housing 202 that is open to the outside and may be provided so that the dust collecting bin 15 is inserted and seated on the seating portion 281. Docking of the dust collecting bin 15 and the docking station 200 may be completed upon the dust collecting bin 15 being removably seated on the seating portion 281.

Although not illustrated in the drawings, depending on the embodiment, a position sensor configured to detect whether the dust collecting bin 15 is connected may be provided inside the seating portion 281. Therefore, when the dust collecting bin 15 is seated on the seating portion 281, the docking station 200 may recognize the docking state of the vacuum cleaner 100 and the docking station 200 through an output value of the position sensor.

A multi-cyclone 18 may be disposed inside the dust collecting bin 15. The dust collecting bin 15 may be provided so that foreign matter is collected to a lower side 18*a* of the multi-cyclone 18. The dust collecting bin 15 may include a first dust collector 15*a* configured to collect relatively large foreign matter that is initially collected and a second dust collector 15*b* configured to collect relatively small foreign matter that is collected by the multi-cyclone 18.

Both the first dust collector 15*a* and the second dust collector 15*b* may be provided to be open to the outside when a dust collecting bin door 19 is open.

Accordingly, when the dust collecting bin door 19 disposed at a lower portion of the dust collecting bin 15 is open, the foreign matter collected in the dust collecting bin 15 may be easily discharged to the seating portion 281.

To this end, the dust collecting bin 15 may include the dust collecting bin door 19 provided to allow the dust collecting bin 15 to be open when connected to the docking station 200, and the docking station 200 may include an opening guide configured to press one side of the dust collecting bin door 19 to open the dust collecting bin door 19 when the dust collecting bin 15 is connected to the docking station 200.

The opening guide may be formed as a partial area of an inner peripheral surface of the seating portion 281. However, the opening guide is not limited thereto and may also be provided as one area that protrudes to the central axis from the inner peripheral surface of the seating portion 281 or provided in the shape of a protrusion, a rib, or the like that protrudes to the central axis from the inner peripheral surface. However, the position and type of the opening guide are not limited to the above example and may vary as long as the structure of the opening guide allows the dust collecting bin door 19 to be open when the dust collecting bin 15 is seated.

The dust collecting bin 15 includes a fixing member configured to, in response to being pressed by an external force, allow the dust collecting bin door 19 to be detached from the dust collecting bin 15 so that the dust collecting bin 15 is open.

Therefore, when the dust collecting bin 15 is docked at the seating portion 281, the fixing member is automatically pressed by the opening guide, and thus, the dust collecting bin door 19 may be opened as the dust collecting bin 15 is docked at the docking station 200.

However, depending on the embodiment which will be described below, the opening guide may include an opening member whose position is changed according to an input, and the opening member may, depending on its position, selectively press one side of the dust collecting bin 15 and cause the dust collecting bin 15 to be open or not open. That is, depending on the position of the opening member according to an input, the dust collecting bin door 19 may be automatically opened or not opened when the dust collecting bin 15 is coupled. The opening member will be described in more detail below.

Further, depending on the embodiment which will be described below, when a door driver which is able to open or close the dust collecting bin door 19 is provided at the docking station 200, the dust collecting bin door 19 may be opened or closed according to the operation of the door driver.

The suction flow path 285 may penetrate from the docking housing 202 to the main body 201 and be connected to the suction device 250.

The suction flow path 285 may deliver an air flow generated due to the suction device 250 to the dust collecting bin 15. That is, a suctioning air flow generated due to the second suction device 250 may be delivered to the inside of the dust collecting bin 15 along the collector 290 and the seating portion 281 through the suction flow path 285, and due to the suctioning air flow, the foreign matter inside the dust collecting bin 15 may be discharged from the dust collecting bin 15 to the seating portion 281 along the air flow and then be collected in the collector 290 through the suction flow path 285.

The collector 290 may include a collector housing 291. The collector housing 291 may form an inner space. That is, the collector housing 291 may correspond to a portion of the suction flow path 285 but is described as a separate configuration for convenience of description.

The collector 290 may include a collector cover (not illustrated). The collector cover may be disposed at a front surface of the collector housing 291. The collector cover may open or close the collector housing 291 so that the inside of the collector 290 is open to the outside in a state in which the panel 204 is separated.

The collector 290 may include a dust bag 293 which is disposed in the inner space of the collector housing 291 and collects foreign matter entering through the suction flow path 285.

The dust bag 293 may be made of a material through which air passes but foreign matter does not pass, and foreign matter entering the collector 290 from the dust collecting bin 15 may be collected in the dust bag 293.

The dust bag 293 may be provided on the suction flow path 285 and may be provided to be separable from the collector 290.

When the docking station 200 is operated and foreign matter is collected in the dust bag 293, the user may separate the panel 204, open a collector cover 292 to separate the dust bag 293 from the collector 290, and discharge the foreign matter collected in the docking station 200.

The second suction device 250 may include the second suction fan 253 and the second motor 251 configured to rotate the second suction fan 253 and may include a suction device housing 206 configured to form an inner space in which the second suction fan 253 is disposed.

The suction device housing 206 may include a suction device cover 207 which is disposed in the main body 201 and configured to open or close the inside of the suction device 250. The suction device cover 207 may be provided to discharge air suctioned by the second suction fan 253.

Referring to FIG. 4, a suctioning air flow formed by the second suction fan 253 may be supplied from the inner space of the suction device housing 206 to the dust collecting bin 15 via the collector 290 through the suction flow path 285.

Specifically, the second suction device 250 may rotate the second suction fan 253 to supply the suctioning air flow to the dust collecting bin 15, and the air moving due to the second suction fan 253 may move from the dust collecting bin 15 to the outside of the docking station 200 via the collector 290.

Also, the second suction device 250 may rotate the second suction fan 253 to allow external air to be suctioned into the outlet 13 provided in the filter housing 12 of the vacuum cleaner 100.

Also, the second suction device 250 may rotate the second suction fan 253 to allow external air to be suctioned into the suction unit 40 of the vacuum cleaner 100. Here, the air suctioned into the suction unit 40 may be discharged to the outside again through the suction device cover 207 via the extension tube 20, the dust collection guide 30, and the dust collecting bin 15.

In this way, since the entire vacuum cleaner 100 may be removably coupled to the docking station 200, in addition to the foreign matter in the dust collecting bin 15, foreign matter remaining in the filter housing 12, the extension tube 20, the dust collection guide 30, and the suction unit 40 may also be removed.

Here, when the second motor 251 is kept turned on and thus the same suctioning air flow is supplied to the dust collecting bin 15, some of the foreign matter may be caught at an inner configuration of the dust collecting bin 15 and not be discharged to the outside. For example, foreign matter such as hair may be caught at an inner configuration of the dust collecting bin 15 and, despite the suctioning air flow, remain inside the dust collecting bin 15 instead of being detached to the outside of the dust collecting bin 15. That is, the suctioning air flow delivered to the inside of the dust collecting bin 15 may be formed to be directed only in the same direction. Accordingly, some of the foreign matter may have resistance against the direction in which the suctioning air flow is formed and may not be detached to the outside of the dust collecting bin 15 despite the suctioning air flow. Therefore, a problem may occur in that foreign matter inside the dust collecting bin 15 is not effectively discharged.

While the suctioning air flow is supplied to the dust collecting bin 15 by the second suction device 250 of the docking station 200 and the air inside the dust collecting bin 15 is suctioned, the cleaning device 1 according to an embodiment may change the suctioning air flow, thus changing a flow rate inside the dust collecting bin 15 and varying an air flow inside the dust collecting bin 15.

When, depending on the embodiment, the docking station 200 controls the second suction device 250 to perform the discharge operation, the docking station 200 may control the second suction device 250 to periodically change a suction force while performing the discharge operation.

Specifically, the docking station 200 may control the second suction device 250 to periodically repeat being turned on and off That is, the docking station 200 may control the power supplied to the second suction device 250 so that the second suction device 250 is periodically turned on and off.

Also, depending on the embodiment, the docking station 200 may control the second suction device 250 to periodically change a rotational speed. That is, the docking station 200 may control the power supplied to the second suction device 250 so that the second suction device 250 periodically changes the rotational speed.

In this way, by periodically changing the suction force of the second suction device 250, the docking station 200 supplies irregular suctioning air flows to the dust collecting bin 15, thus allowing the foreign matter in the dust collecting bin 15 to be discharged more efficiently. The embodiment in which the suction force of the second suction device 250 is periodically changed to perform the discharge operation will be described in more detail below.

Also, depending on the embodiment, in order to supply irregular suctioning air flows to the dust collecting bin 15, the cleaning device 1 may control the vacuum cleaner 100 so that a first suction device (cleaner suction device) 150 of the vacuum cleaner 100 operates while the second suction device 250 operates.

That is, the cleaning device 1 may also control the first suction device 150 of the vacuum cleaner 100 coupled to the docking station 200 to operate in order to more efficiently remove the foreign matter from inside the dust collecting bin 15. In other words, the vacuum cleaner 100 and the docking station 200 may communicate with each other so that the first suction device 150 operates in a state in which the second suction device 250 operates. For example, the docking station 200 may transmit to the vacuum cleaner 100 a control command for the first suction device 150 to operate while the second suction device 250 operates. In this case, the vacuum cleaner 100 may control the first suction device 150 to operate while the second suction device 250 operates.

The first suction device 150 is provided inside the main body 11 of the vacuum cleaner 100 and includes a first motor 151 and a first suction fan 153 configured to receive a rotational force from the first motor 151 and rotate.

Referring to FIG. 5, a suctioning air flow formed by the first suction fan 153 may be supplied to the dust collecting bin 15 and may move in a direction opposite to a direction of movement of a suctioning air flow formed by the second suction fan 253. That is, while the suctioning air flow formed by the second suction fan 253 may be formed in a downward direction, the suctioning air flow formed by the first suction fan 153 may be formed in an upward direction.

Here, by periodically changing a suction force in a state in which the second suction fan 253 operates, alternately operating with the second suction fan 253, or maintaining the on-state in a state in which the second suction fan 253 periodically changes a suction force, the first suction fan 153 may periodically change a flow rate of a suctioning air flow supplied to the dust collecting bin 15.

As directions of air flows instantaneously change, some of the foreign matter having resistance against a specific direction may lose the resistance due to air flowing in another direction and may be detached to the outside of the dust collecting bin 15 along with the air flow.

Here, the foreign matter separated from the dust collecting bin 15 and discharged may move together with air due to operation of the second suction fan 253 and be collected in the collector 290 provided on the suction flow path 285.

That is, the cleaning device 1 may simultaneously control the first suction device 150 of the vacuum cleaner 100 and the second suction device 250 of the docking station 200 to change an air flow inside the dust collecting bin 15. In this way, foreign matter may be discharged more efficiently from inside the dust collecting bin 15. Also, as the first suction device 150 operates, the foreign matter remaining in the extension tube 20, the dust collection guide 30, and the suction unit 40 may also be gathered into the dust collecting bin 15.

The embodiment in which the first suction device 150 (the first motor 151) operates while the second suction device 250 (the second motor 251) operates in order to remove foreign matter from inside the dust collecting bin 15 will be described in more detail below.

Hereinafter, an input member and the opening member will be described in more detail.

Figure 6:
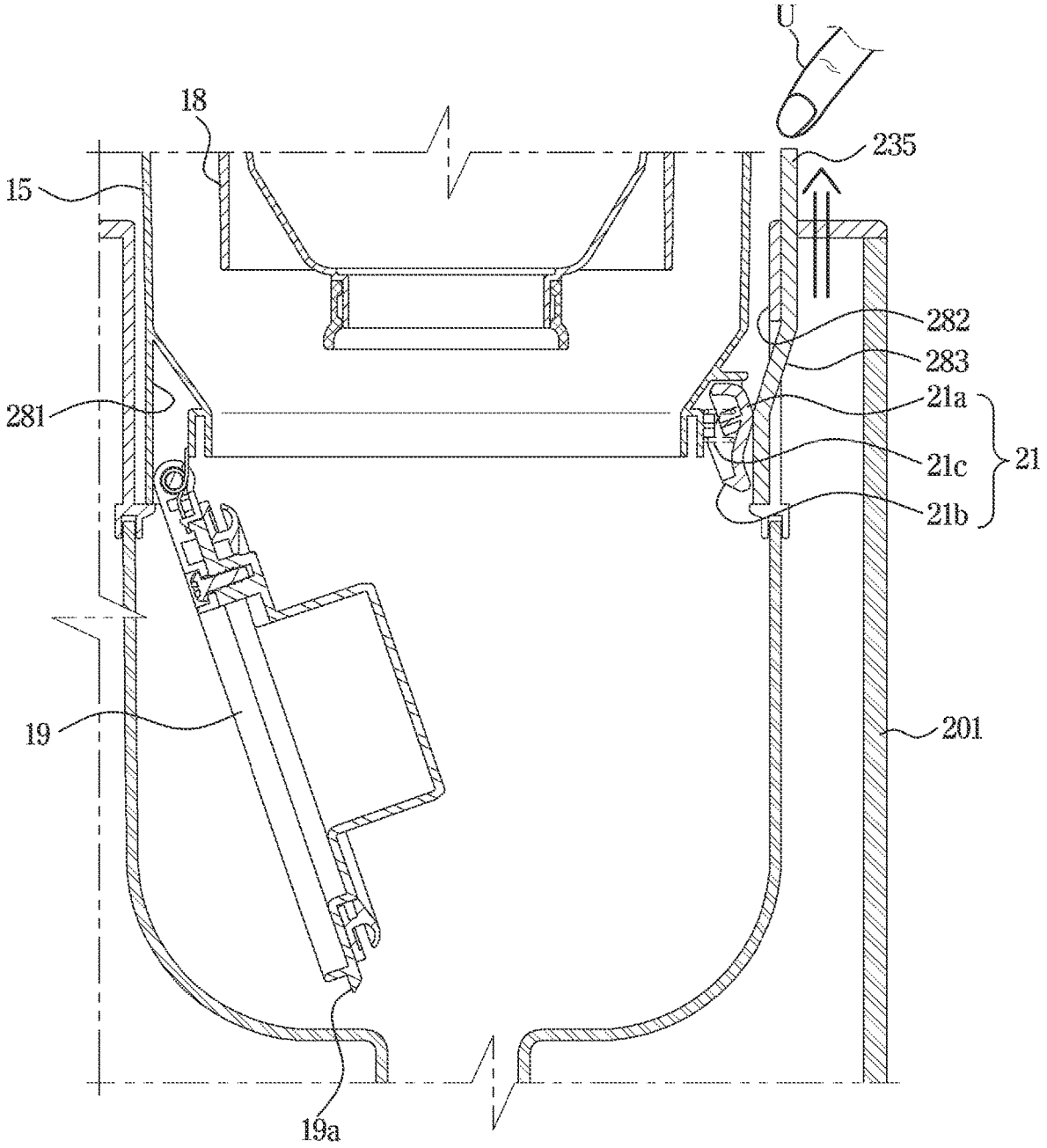
FIG. 6 is a view illustrating a case in which an opening member is disposed at a position opening a dust collecting bin door according to an embodiment of the disclosure.
Figure 7:
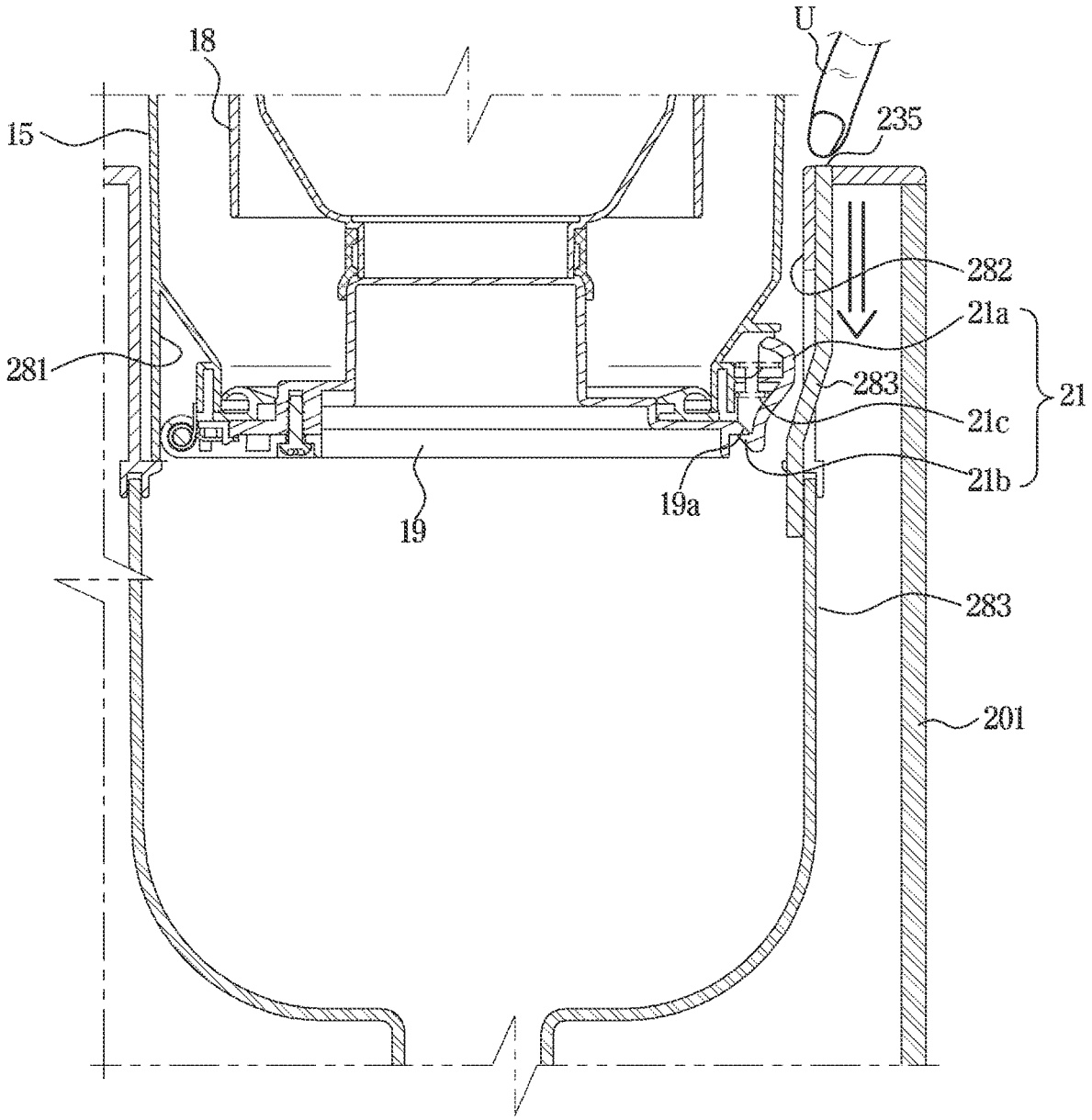
FIG. 7 is a view illustrating a case in which the opening member is disposed at a position not opening the dust collecting bin door according to an embodiment of the disclosure.

FIG. 6 is a view illustrating a case in which the opening member is disposed at a position opening the dust collecting bin door 19 according to an embodiment of the disclosure. FIG. 7 is a view illustrating a case in which the opening member is disposed at a position not opening the dust collecting bin door 19 according to an embodiment of the disclosure.

The dust collecting bin 15 may include the dust collecting bin door 19 provided to allow the dust collecting bin 15 to be open when connected to the docking station 200, and the docking station 200 may include an opening guide 282 configured to press one side of the dust collecting bin door 19 to open the dust collecting bin door 19 when the dust collecting bin 15 is connected to the docking station 200. The opening guide 282 may be formed as a partial area of the inner peripheral surface of the seating portion 281.

The dust collecting bin 15 may include a fixing member 21 which is disposed at one side of a lower end of the dust collecting bin 15 and supports a coupling protrusion 19*a*, which is provided at one side of the dust collecting bin door 19, to prevent the dust collecting bin door 19 from being detached from the lower end of the dust collecting bin 15. When pressed by an external force, the fixing member 21 allows the dust collecting bin door 19 to be detached from the dust collecting bin 15 so that the dust collecting bin 15 is open.

The fixing member 21 may be hook-coupled to the coupling protrusion 19*a* and prevent the coupling protrusion 19*a* from being detached to the outside of the dust collecting bin 15.

The fixing member 21 may include a push portion 21*a* which is provided to rotate and release the hook-coupling to the coupling protrusion 19*a* when the fixing member 21 is pressed by an external force and a hook 21*b* which interlocks with the push portion 21*a* and is hook-coupled to the coupling protrusion 19*a*.

The fixing member 21 may include an elastic member 21*c* which is provided to maintain the hook-coupling state between the hook 21*b* and the coupling protrusion 19*a* when the fixing member 21 is not pressed by the push portion 21*a*.

The elastic member 21*c* may be biased so that the hook 21*b* is pressed toward the coupling protrusion 19*a* and the hook-coupling therebetween is maintained.

When the push portion 21*a* is pressed by a force greater than an elastic force at which the elastic member 21*c* is biased, the hook 21*b* may interlock with the push portion 21*a* and rotate, the hook-coupling between the hook 21*b* and the coupling protrusion 19*a* may be released, and the dust collecting bin door 19 may be detached from the dust collecting bin 15 so that the dust collecting bin 15 is open.

The push portion 21*a* may be provided to protrude outward from an outer peripheral surface in a radial direction of the central axis of the dust collecting bin 15.

Therefore, when the dust collecting bin 15 is docked at the seating portion 281, the fixing member 21 may be automatically pressed toward the opening guide 282, and the dust collecting bin door 19 may be opened as the dust collecting bin 15 is docked at the docking station 200.

However, referring to FIGS. 6 and 7, the opening guide 282 according to an embodiment may include an opening member 283 whose position is changed according to an input, and the opening member 283 may, depending on its position, selectively press one side of the dust collecting bin 15 and cause the dust collecting bin 15 to be open or not open. For example, depending on the position of the opening member 283 according to an input of a user U, the dust collecting bin door 19 may be automatically opened or not opened when the dust collecting bin 15 is coupled. To this end, the opening member 283 may have a slope that is tilted more outward from the center of the main body 201 toward the top.

An input device of the docking station 200 that will be described below may, depending on the embodiment, include an input member 235 which is connected to the opening member 283 provided at the opening guide 282 and a sensor (e.g., a piezoelectric sensor or the like) which is able to detect the position of the input member 235.

Here, the position of the opening member 283 may be changed according to an input provided through the input member 235. For example, by changing the position of the opening member 283 through the input member 235, the user U may cause the dust collecting bin door 19 of the dust collecting bin 15 to be automatically opened or may manually open the dust collecting bin door 19 of the dust collecting bin 15.

Specifically, as illustrated in FIGS. 6 and 7, the input member 235 may be formed in the shape of a bar that includes one end which is connected to the opening member 283 provided at the opening guide 282 and the other end which protrudes to an upper side of the main body 201. The user may move the position of the input member 235 downward or upward to cause the opening member 283 to move downward or upward. Here, through the movement, the opening member 283 may be disposed at a first position (see FIG. 6) at which the opening member 283 presses the fixing member 21 of the dust collecting bin 15 or may be disposed at a second position (see FIG. 7) at which the opening member 283 is spaced apart from the fixing member 21 of the dust collecting bin 15.

In other words, as illustrated in FIG. 7, the user may move the input member 235 downward, and the opening member 283 connected to the input member 235 may also move downward and be disposed at the second position. In this case, the opening member 283 is spaced apart from the push portion 21*a* of the fixing member 21 and does not press the push portion 21*a*, thus preventing the dust collecting bin door 19 from being opened.

Also, as illustrated in FIG. 6, the user may move the input member 235 upward, and the opening member 283 connected to the input member 235 may also move upward and be disposed at the first position. In this case, the opening member 283 presses the push portion 21*a* of the fixing member 21, thus causing the dust collecting bin door 19 to be opened.

That is, when the vacuum cleaner 100 is coupled to the docking station 200 in a state in which the opening member 283 is disposed at the first position, the dust collecting bin door 19 may be automatically opened. In this case, the cleaning device 1 may, based on the position of the input member 235, determine that the dust collecting bin door 19 will be automatically opened and determine to perform the discharge operation upon the vacuum cleaner 100 being coupled to the docking station 200.

Also, when the vacuum cleaner 100 is coupled to the docking station 200 in a state in which the opening member 283 is disposed at the second position, the dust collecting bin door 19 may not be opened, and the dust collecting bin door 19 may be opened only in a case in which the opening member 283 moves to the first position according to a user input. In this case, the cleaning device 1 may determine to perform the discharge operation only in a case in which the opening member 283 moves to the first position based on the position of the input member 235.

However, depending on the embodiment which will be described below, in a case in which a door driver configured to open or close the dust collecting bin door 19 is provided at the docking station 200, the dust collecting bin door 19 may be opened or closed according to the operation of the door driver, regardless of the position of the opening member 283.

Figure 8:
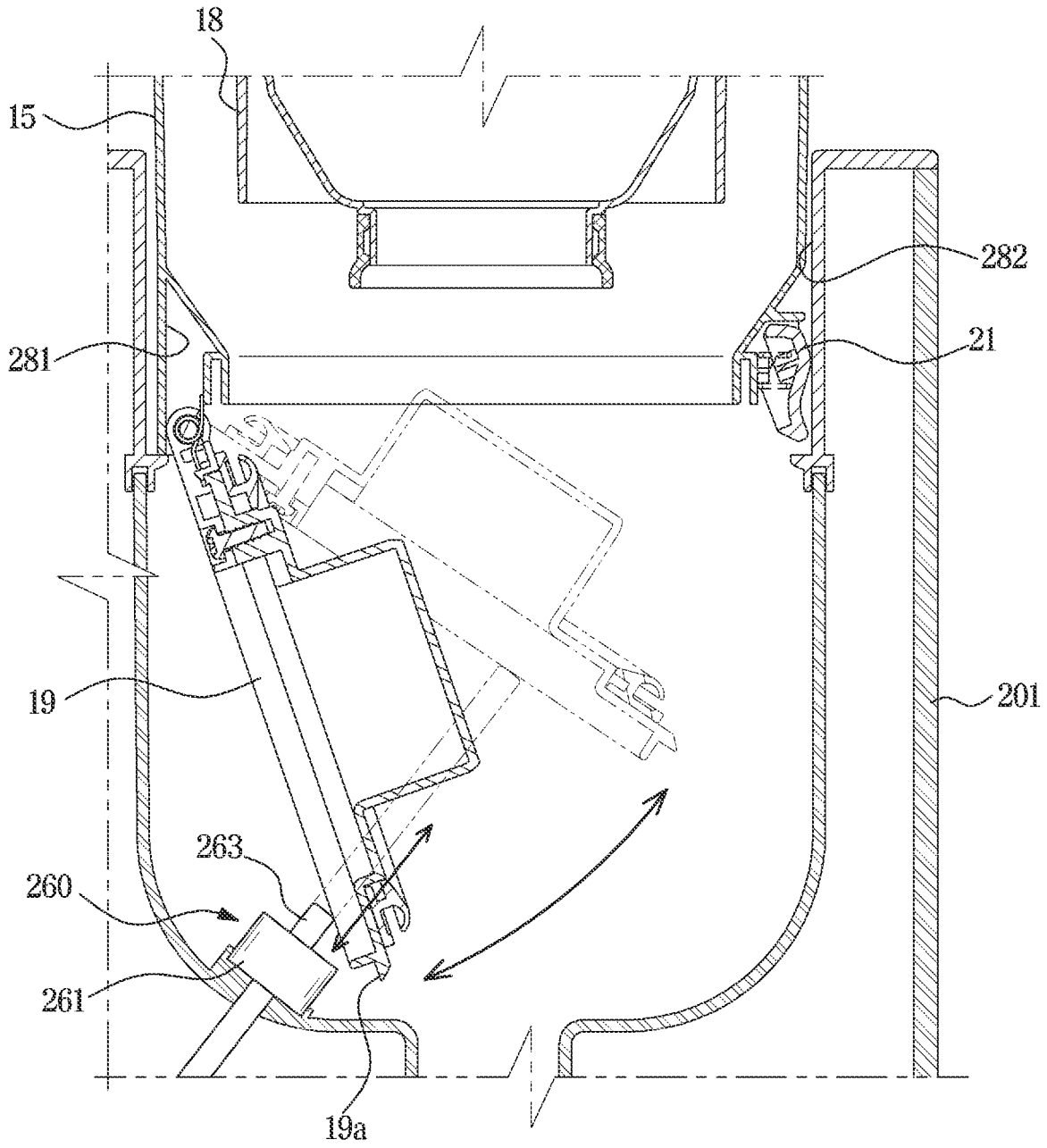
FIG. 8 is a view illustrating a case in which a door driver presses the dust collecting bin door according to an embodiment of the disclosure.
Figure 9:
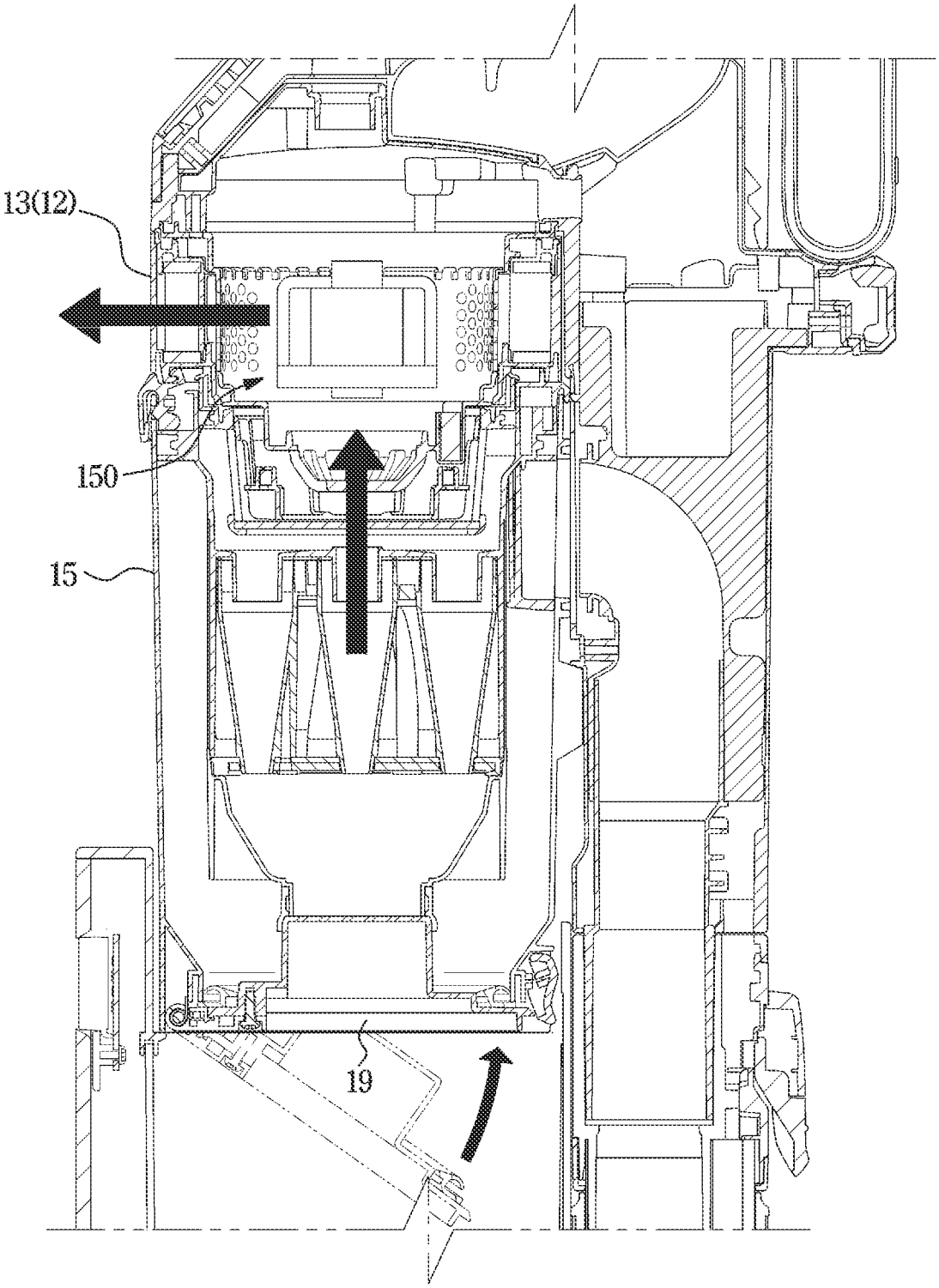
FIG. 9 is a view for describing a case in which the cleaning device controls the first suction device of the vacuum cleaner upon an end of the discharge operation according to an embodiment of the disclosure.

FIG. 8 is a view illustrating a case in which a door driver 260 presses the dust collecting bin door 19 according to an embodiment of the disclosure. FIG. 9 is a view for describing a case in which the cleaning device 1 controls the first suction device 150 of the vacuum cleaner 100 upon an end of the discharge operation according to an embodiment of the disclosure.

The cleaning device 1 may end the discharge operation upon a predetermined amount of time elapsing after the start of the discharge operation or upon receiving a command to end the discharge operation from the input device of the docking station 200 or from a user terminal. Also, depending on the embodiment, the cleaning device 1 may end the discharge operation when a level at which the dust collecting bin 15 is filled to capacity with foreign matter is less than a predetermined value or when the collector 290 is at capacity.

The cleaning device 1 according to an embodiment may close the dust collecting bin door 19 upon ending the discharge operation.

Depending on the embodiment, the cleaning device 1 may include the door driver 260 configured to press the dust collecting bin door 19 as illustrated in FIG. 8 and may control the door driver 260 to close the dust collecting bin door 19 upon an end of the discharge operation.

Specifically, in a case in which the docking station 200 according to an embodiment includes the door driver 260, the docking station 200 may control the door driver 260 so that the dust collecting bin 15 is closed by the dust collecting bin door 19 upon an end of the discharge operation.

The door driver 260 may be provided to press the dust collecting bin door 19. For example, the door driver 260 may be provided at one side of the seating portion 281 and may include a pressing member 263 which is configured to press the dust collecting bin door 19 detached from the dust collecting bin 15 and an actuator 261 which is configured to extend the pressing member 263.

By operating the actuator 261 to extend the pressing member 263 when the discharge operation has ended, the door driver 260 causes the dust collecting bin door 19 to be closed. That is, when the discharge operation has ended, the door driver 260 controls the actuator 261 to extend the pressing member 263. Here, the pressing member 263 extends due to the actuator 261 and causes the dust collecting bin door 19 to be closed. For example, the pressing member 263 extends due to the actuator 261 and causes the coupling protrusion 19*a* of the dust collecting bin door 19 to be hook-coupled to the fixing member 21 of the dust collecting bin 15. In this way, the dust collecting bin door 19 may be coupled to a lower end of the dust collecting bin 15 so that the dust collecting bin 15 is closed.

The docking station 200 may determine to end the discharge operation and may control the door driver 260 to close the dust collecting bin door 19. Also, depending on the embodiment, the docking station 200 may receive an operation command relating to the door driver 260 from the vacuum cleaner 100 and control the door driver 260 to close the dust collecting bin door 19.

Also, in a case in which the vacuum cleaner 100 is coupled to the docking station 200 and the discharge operation is started, the docking station 200 may control the door driver 260 to open the dust collecting bin door 19. For example, by controlling the actuator 261 to shorten the pressing member 263, the docking station 200 causes the dust collecting bin door 19 to be opened. In this case, the dust collecting bin door 19 may be opened when the pressing member 263 is shortened in a state in which the fixing member 21 is pressed by the opening guide 282.

In this way, the door driver 260 may extend or shorten the pressing member 263 to open or close the dust collecting bin door 19. However, an implementation form of the door driver 260 is not limited to the above example and may vary as long as the form allows the door driver 260 to open or close the dust collecting bin door 19 according to an operation of the actuator 261. For example, the door driver 260 may include a magnetic body provided to correspond to a magnetic body provided at the dust collecting bin door 19 and may control the actuator 261 to change the position of the magnetic body to open or close the dust collecting bin door 19.

Depending on the embodiment, upon an end of the discharge operation, the cleaning device 1 may control the first suction device 150 of the vacuum cleaner 100 to rotate at a high speed to supply a strong suctioning air flow to the dust collecting bin door 19, thus closing the dust collecting bin door 19 as illustrated in FIG. 9.

Specifically, the vacuum cleaner 100 may determine to end the discharge operation and may supply high power to the first suction device 150, thus controlling the first suction device 150 to rotate at a high speed. Also, depending on the embodiment, upon receiving a control command relating to high-speed rotation of the first suction device 150 from the docking station 200, the vacuum cleaner 100 may control the first suction device 150 to rotate at a high speed.

In this case, the strong suctioning air flow caused by the high-speed rotation of the first suction device 150 may cause the dust collecting bin door 19 to be closed, thus causing the dust collecting bin 15 to be closed. That is, upon an end of the discharge operation, the first suction device 150 rotates at a high speed and generates a strong suctioning air flow, thus causing the dust collecting bin door 19 to be closed. For example, the first suction device 150 rotates at a high speed and generates a strong suctioning air flow, thus causing the coupling protrusion 19*a* of the dust collecting bin door 19 to be hook-coupled to the fixing member 21 of the dust collecting bin 15. In this way, the dust collecting bin door 19 may be coupled to the lower end of the dust collecting bin 15 so that the dust collecting bin 15 is closed.

In this way, using the door driver 260 or the first suction device 150, the cleaning device 1 may allow the dust collecting bin door 19 to be closed, which causes the dust collecting bin 15 to be closed, upon an end of the discharge operation.

In this way, even when the user separates the vacuum cleaner 100 from the docking station 200, the user may be provided with a state in which the dust collecting bin door 19 is closed. Thus, without a separate additional operation, the user may use the vacuum cleaner 100 to perform cleaning.

The case in which the cleaning device 1 closes the dust collecting bin door 19 upon ending the discharge operation has been described above. Hereinafter, a case in which the cleaning device 1 informs of capacity of the collector 290 will be described in detail.

Figure 10:
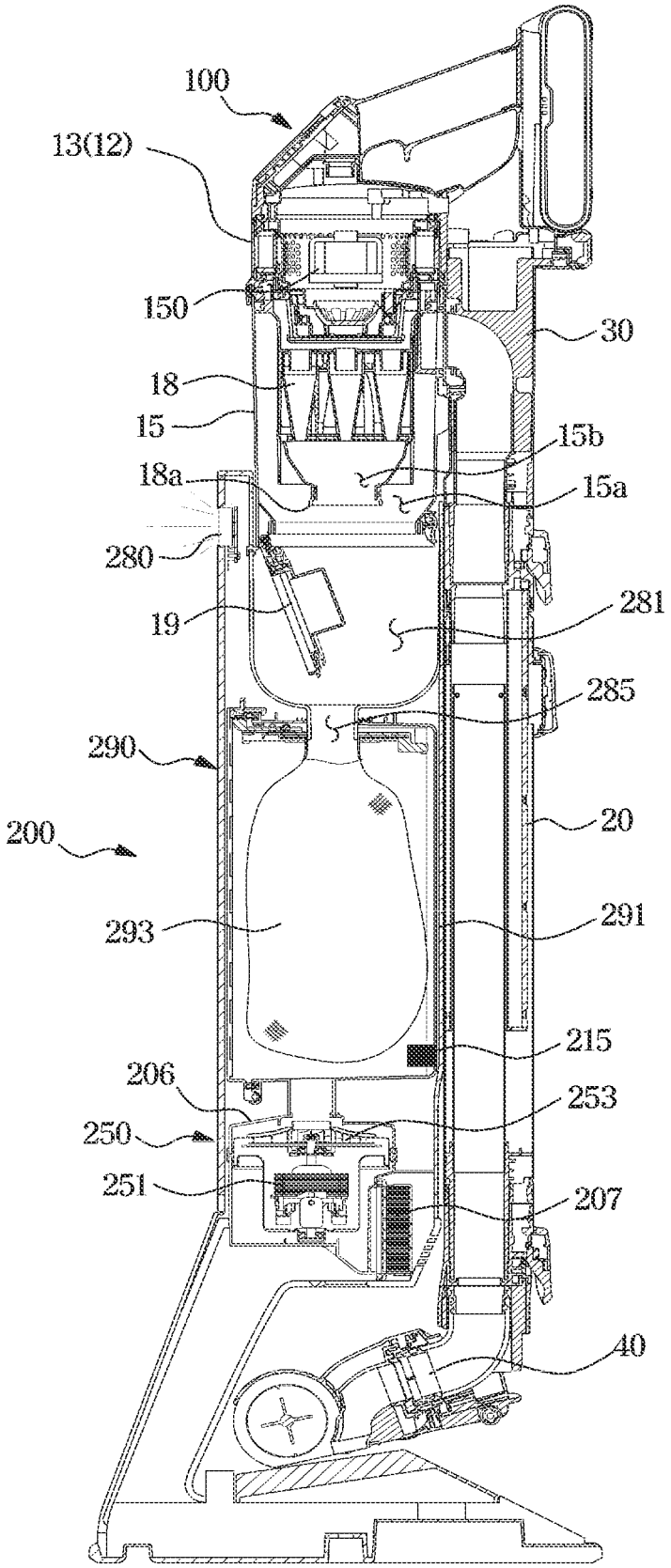
FIG. 10 is a view for describing a case in which the docking station determines capacity of a collector according to an embodiment of the disclosure.

FIG. 10 is a view for describing a case in which the docking station 200 determines capacity of the collector 290 according to an embodiment of the disclosure.

Referring to FIG. 10, the cleaning device 1 according to an embodiment may, based on an output of a collector sensor 215, determine whether the collector 290 is filled to capacity and may control the display 280 to display the capacity of the collector 290 in a case in which the collector 290 is at capacity.

For example, the docking station 200 may control the display 280 to output first light (e.g., blue light) in a case in which the collector 290 is not at capacity. Also, the docking station 200 may control the display 280 to output second light (e.g., red light) in the case in which the collector 290 is filled to capacity and may control the display 280 to continue outputting the second light (e.g., red light) until the dust bag 293 of the collector 290 is replaced.

Depending on the embodiment, the collector sensor 215 may be provided as a pressure sensor disposed in the suction flow path 285. For example, as illustrated in FIG. 10, the collector sensor 215 may be provided in the collector housing 291. However, the position of the collector sensor 215 is not limited thereto and may vary as long as the position allows the collector sensor 215 to measure a pressure of a suctioning air flow. The collector sensor 215 may also be disposed in the suction device housing 206.

In this case, in a case in which the collector 290 is filled to capacity and interferes with a suctioning air flow of the second suction device 250, the collector sensor 215 may detect a pressure different from a pressure at the time of normal operation.

In this way, in the case in which the collector sensor 215 outputs a pressure different from a pressure at the time of normal operation, the docking station 200 may determine that the collector 290 is filled to capacity and may control the display 280 to display the capacity of the collector 290.

However, the collector sensor 215 is not limited to the above example and may also be provided as a light sensor, a camera, or the like that is provided in the collector housing 291 to detect capacity of the collector 290.

The display 280 according to an embodiment may further include an inner display which is provided in the seating portion 281 to irradiate the dust collecting bin 15 with light from inside the seating portion 281. In this case, in the case in which the collector 290 is filled to capacity, the cleaning device 1 may control the inner display to display the capacity of the collector 290.

Specifically, the docking station 200 may control the inner display to output the first light (e.g., blue light) in the case in which the collector 290 is not at capacity. Also, the docking station 200 may control the inner display to output the second light (e.g., red light) in the case in which the collector 290 is filled to capacity and may control the inner display to continue outputting the second light (e.g., red light) until the dust bag 293 of the collector 290 is replaced.

Structural features of the cleaning device 1 have been described in detail above. Hereinafter, a control configuration for irregularly supplying a suctioning air flow to the dust collecting bin 15 connected to the docking station 200 will be described in detail.

Figure 11:
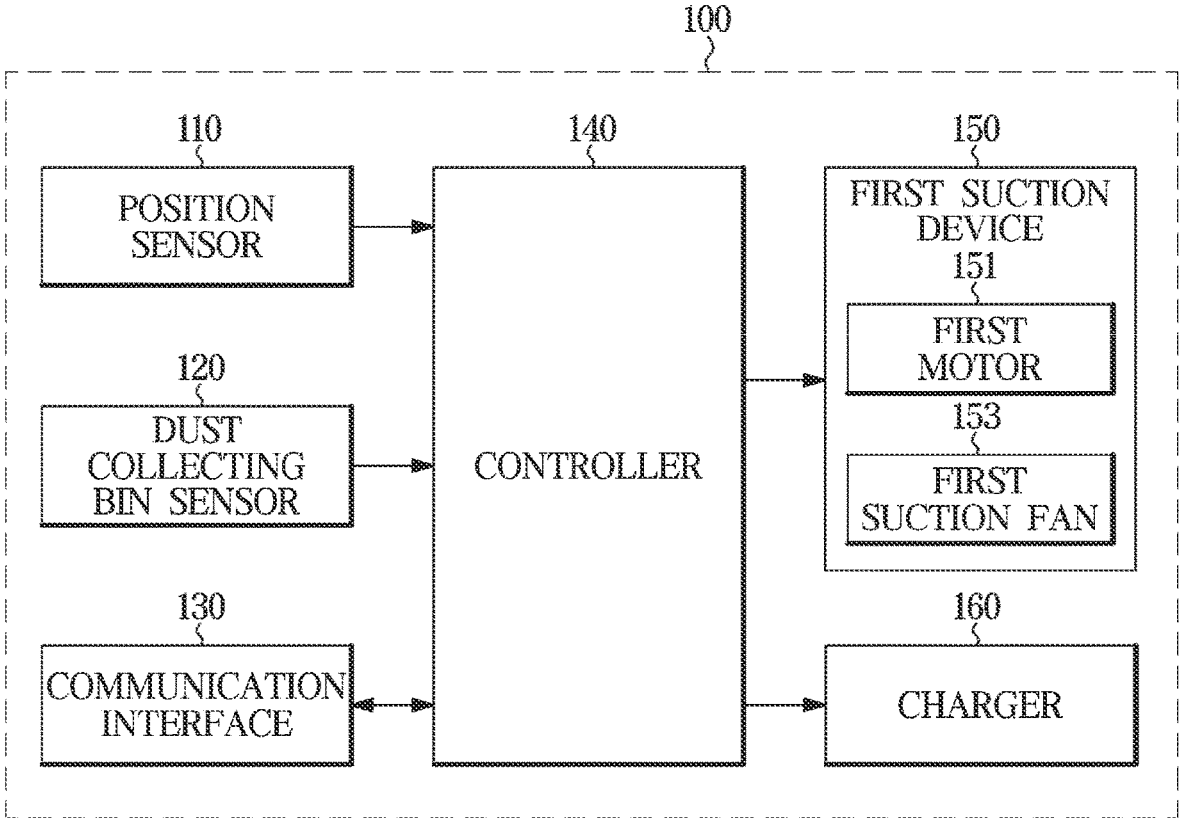
FIG. 11 is a control block diagram of the vacuum cleaner according to an embodiment of the disclosure.

FIG. 11 is a control block diagram of the vacuum cleaner 100 according to an embodiment of the disclosure.

Referring to FIG. 11, the vacuum cleaner 100 according to an embodiment may include a position sensor 110 configured to detect whether the vacuum cleaner 100 is docked at the docking station 200, a dust collecting bin sensor 120 configured to detect a capacity level of the dust collecting bin 15, a communication interface 130 configured to perform communication with an external electronic device, a controller 140 configured to control a cleaning operation performing cleaning or the discharge operation discharging foreign matter from inside the dust collecting bin 15, the first suction device 150 configured to provide a suctioning air flow, and a charger 160 configured to control charging of the battery 16.

However, each configuration of the vacuum cleaner 100 that is illustrated in FIG. 11 may be omitted depending on the embodiment, and the vacuum cleaner 100 may, depending on the embodiment, further include another configuration (e.g., a storage (for example, a flash memory, a random access memory (RAM), a hard disk drive (HDD), etc.) configured to store various pieces of information) in addition to the configurations illustrated in FIG. 11.

The position sensor 110 according to an embodiment may detect whether the vacuum cleaner 100 is coupled to the docking station 200.

To this end, the position sensor 110 may be provided at one side surface of the dust collecting bin 15 and may, in a case in which the dust collecting bin 15 is coupled to the seating portion 281, output a different output value as compared to when the dust collecting bin 15 is not coupled to the seating portion 281.

For example, the position sensor 110 may be provided as an infrared sensor, a piezoelectric sensor, or the like, but is not limited thereto, and any other sensor may be used as the position sensor 110 as long as the sensor is able to vary output values according to whether the dust collecting bin 15 is coupled to the seating portion 281.

The dust collecting bin sensor 120 may detect a capacity level of the dust collecting bin 15.

To this end, the dust collecting bin sensor 120 may be provided at one side of the dust collecting bin 15 and may be provided as a camera sensor, an ultrasonic sensor, a pressure sensor, or the like to output different values according to the capacity level of the dust collecting bin 15.

However, the dust collecting bin sensor 120 is not limited to the above examples and may also be provided as a sensor, such as a current sensor and a Hall sensor, that is able to detect an operational change of the first motor 151 due to the capacity level of the dust collecting bin 15.

In this way, the position and type of the dust collecting bin sensor 120 are not limited and may vary as long as the sensor is able to detect a capacity level of the dust collecting bin 15.

The communication interface 130 according to an embodiment may perform communication with an external electronic device. Specifically, the communication interface 130 may transmit and receive information to and from the docking station 200 and a user terminal through wireless communication. To this end, the communication interface 130 may be configured as a wireless communication module that uses a known type of wireless communication protocol.

The controller 140 according to an embodiment may control the discharge operation removing foreign matter from inside the dust collecting bin 15.

Here, depending on the embodiment, the controller 140 may transmit a control command to the docking station 200 while controlling the first suction device 150, thus performing the discharge operation.

Conversely, depending on the embodiment, the controller 140 may receive a control command from the docking station 200 and may, according to the received control command, control the first suction device 150 to perform the discharge operation.

Here, the first suction device 150 may include the first motor 151 configured to operate according to control of the controller 140 and the first suction fan 153 configured to receive a rotational force from the first motor 151 and rotate, thus supplying a suctioning air flow to the dust collecting bin 15.

First, in the embodiment in which a control command is transmitted to the docking station 200, the controller 140 may, based on an output of the position sensor 110, determine whether the vacuum cleaner 100 is coupled to the docking station 200.

Here, in a case in which the vacuum cleaner 100 is coupled to the docking station 200, the controller 140 may control the cleaning device 1 to perform the discharge operation.

Specifically, the controller 140 may control the first suction device 150 to operate and may control the communication interface 130 to transmit to the docking station 200 a control command for operation of the second suction device 250.

For example, the controller 140 may control the first suction device 150 to repeat being turned on and off and may control the communication interface 130 to transmit to the docking station 200 a control command for the second suction device 250 to be turned on.

Also, the controller 140 may control the first suction device 150 and the communication interface 130 so that the first suction device 150 and the second suction device 250 alternately operate with each other.

Also, the controller 140 may control the first suction device 150 to be turned on and may control the communication interface 130 to transmit to the docking station 200 a control command for the second suction device 250 to repeat being turned on and off.

Depending on the embodiment, in the case in which the vacuum cleaner 100 is coupled to the docking station 200, the controller 140 may determine whether to perform the discharge operation. Also, upon deciding to perform the discharge operation, the controller 140 may control the first suction device 150 and the communication interface 130 so that the first suction device 150 and the second suction device 250 start to operate.

That is, depending on the embodiment, the controller 140 may not perform the discharge operation when not necessary, even in the case in which the vacuum cleaner 100 is coupled to the docking station 200. In this way, the controller 140 may prevent unnecessary power consumption and noise generation.

For example, the controller 140 may determine to perform the discharge operation upon determining, based on an output of the dust collecting bin sensor 120, that the capacity level of the dust collecting bin 15 is a predetermined value or more. However, depending on the embodiment, the controller 140 may also determine whether to perform the discharge operation based on an output of a dust collecting bin sensor of the docking station 200 that is received through the communication interface 130.

Also, for example, the controller 140 may determine to perform the discharge operation in a case in which the controller 140 receives a discharge command as an input through the operation panel 17 or receives a discharge operation start command from a user terminal through the communication interface 130.

Also, for example, the controller 140 may determine to perform the discharge operation in a case in which the controller 140 receives information, which indicates that the discharge operation start command has been received as an input from the user through the inputter, from the docking station 200 through the communication interface 130.

Also, in the embodiment in which a control command is received from the docking station 200, the controller 140 may receive a control command for operation of the first suction device 150 from the docking station 200 through the communication interface 130.

Depending on the embodiment, the controller 140 may receive the control command for operation of the first suction device 150 after a predetermined amount of time has elapsed from the start of the discharge operation. In this case, the second suction device 250 may solely operate without operation of the first suction device 150 for the predetermined amount of time from the start of the discharge operation. In this way, foreign matter in the dust collecting bin 15 may be discharged to the docking station 200 first.

In a case in which the controller 140 receives the control command for operation of the first suction device 150 from the docking station 200 through the communication interface 130, the controller 140 may control the first suction device 150 to operate. For example, the controller 140 may control a suction force of the first suction device 150 to be periodically changed while the second suction device 250 is turned on. Also, the controller 140 may control the first suction device 150 to operate alternately with the second suction device 250. In addition, the controller 140 may control the first suction device 150 to be turned on while the second suction device 250 periodically changes a suction force.

Here, controlling the suction force of the first suction device 150 to be periodically changed may include controlling the first suction device 150 to be periodically turned on and off and controlling a rotational speed of the first suction device 150 to be periodically changed.

In this way, the cleaning device 1 may operate the first suction fan 153 in a state in which the second suction fan 253 operates, thus periodically changing a flow rate of a suctioning air flow supplied to the dust collecting bin 15.

However, depending on the embodiment, without the operation of the first suction device 150, the suction force of the second suction device 250 may be periodically changed to provide irregular suctioning air flows to the dust collecting bin 15.

As directions of air flows instantaneously change, some of the foreign matter having resistance against a specific direction may lose the resistance due to air flowing in another direction and may be detached to the outside of the dust collecting bin 15 along with the air flow.

Also, depending on the embodiment, the controller 140 may receive a control command for the first suction device 150 to continuously operate for a predetermined amount of time before an end of the discharge operation. In this case, the first suction device 150 may solely operate without operation of the second suction device 250 for the predetermined amount of time before the end of the discharge operation. In this way, foreign matter that may remain between the dust collecting bin 15 and the dust collecting bin door 19 may be absorbed into the dust collecting bin 15 again. Thus, sealing between the dust collecting bin 15 and the dust collecting bin door 19 may be made complete to guarantee a suction force during the cleaning operation, and foreign matter between the dust collecting bin 15 and the dust collecting bin door 19 may be prevented from being exposed to the outside to improve user satisfaction.

Upon the end of the discharge operation, the controller 140 according to an embodiment may control the first suction device 150 so that the first suction fan 153 of the first suction device 150 rotates at a high speed.

Specifically, upon a predetermined amount of time elapsing after the start of the discharge operation or upon receiving a command to end the discharge operation from the operation panel 17 or a user terminal, the controller 140 may supply high power to the first suction device 150 so that the first suction device 150 forms a strong suctioning air flow.

Also, upon receiving a discharge operation end command from the docking station 200 according to the end of the discharge operation, the controller 140 may supply high power to the first suction device 150 so that the first suction device 150 forms a strong suctioning air flow.

In this way, even when the user separates the vacuum cleaner 100 from the docking station 200, the user may be provided with a state in which the dust collecting bin door 19 is closed. Thus, without a separate additional operation, the user may use the vacuum cleaner 100 to perform cleaning.

When the first suction fan 153 of the first suction device 150 rotates according to a suctioning air flow due to the second suction device 250 in a situation in which power is not supplied to the first suction device 150, the controller 140 according to an embodiment may charge the battery 16 using current induced by rotation of the first suction fan 153. That is, when, in a state in which the first suction device 150 is turned off, the first suction device 150 rotates in a different direction as compared to when power is supplied thereto due to a suctioning air flow induced by the second suction device 250, the controller 140 may supply current inducted by the first suction device 150 to the battery 16 to charge the battery 16.

In the case in which the vacuum cleaner 100 is docked at the docking station 200, the controller 140 according to an embodiment may control the communication interface 130 to transmit battery charge state information to the docking station 200. In this way, the docking station 200 may supply power for fully charging the battery 16 to the vacuum cleaner 100.

Here, the controller 140 may control the charger 160 to start or end charging of the battery 16. For example, the controller 140 may control the charger 160 to not charge the battery 16 while the discharge operation is performed and the first suction device 150 operates and to charge the battery 16 while the discharge operation is not performed.

The controller 140 may include at least one memory configured to store a program for performing the above-described operations and operations described below and at least one processor configured to execute the stored program. In a case in which a plurality of memories and a plurality of processors are provided, the plurality of memories and plurality of processors may be integrated into a single chip or may be provided at physically isolated locations.

The first suction device 150 according to an embodiment may, according to control of the controller 140, receive power for driving the first motor 151 and may, as the first suction fan 153 rotates according to the operation of the first motor 151, generate a suctioning air flow.

The charger 160 according to an embodiment may, according to control of the controller 140, control charging or discharging of the battery 16.

Specifically, in the case in which the vacuum cleaner 100 is seated on the docking station 200 and connected to the charging terminal 275 of the docking station 200, the charger 160 may change a first switch, which connects the charging terminal 275 and the battery 16, to the on-state to charge the battery 16. However, in order to supply power from the battery 16 to the first suction device 150 during the discharge operation in which the first suction device 150 operates, the charger 160 may change the first switch to the off-state and change a second switch, which connects the battery 16 and the first suction device 150, to the on-state.

Figure 12:
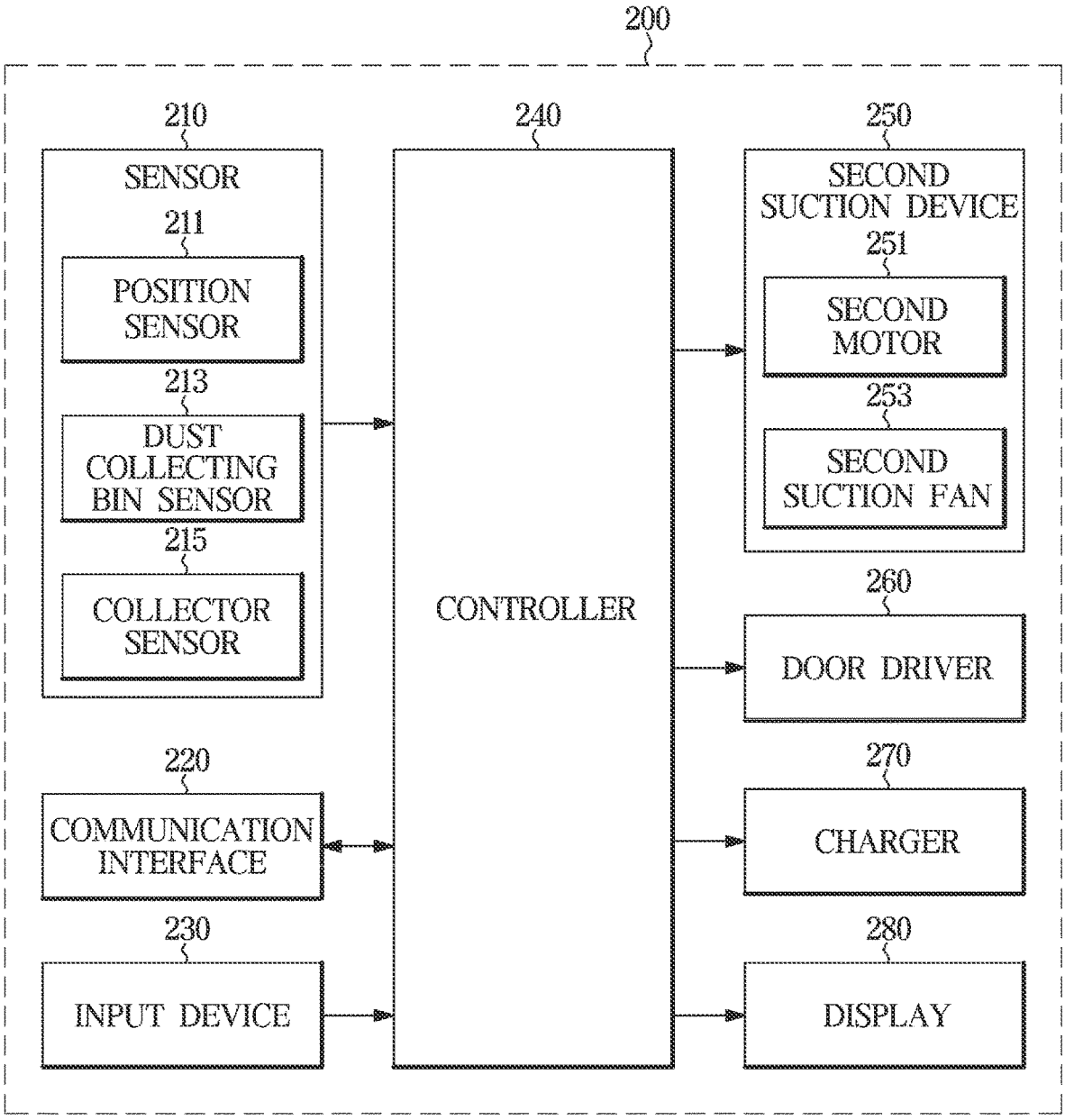
FIG. 12 is a control block diagram of the docking station according to an embodiment of the disclosure.

FIG. 12 is a control block diagram of the docking station 200 according to an embodiment of the disclosure.

Referring to FIG. 12, the docking station 200 according to an embodiment may include a sensor 210 configured to sense various pieces of information, a communication interface 220 configured to perform communication with an external electronic device, an input device 230 configured to receive an input, a controller 240 configured to control the discharge operation, the second suction device 250 configured to supply a suctioning air flow to the dust collecting bin 15, the door driver 260 configured to open or close the dust collecting bin door 19 of the dust collecting bin 15, a charger 270 configured to charge the battery 16 of the vacuum cleaner 100, and the display 280 configured to display an operational state.

However, each configuration of the docking station 200 that is illustrated in FIG. 12 may be omitted depending on the embodiment, and the docking station 200 may, depending on the embodiment, further include another configuration (e.g., a storage (for example, a flash memory, a RAM, an HDD, etc.) configured to store various pieces of information) in addition to the configurations illustrated in FIG. 12.

The sensor 210 according to an embodiment may include a plurality of sensors configured to sense various pieces of information, and the plurality of sensors may be provided as different devices at different locations.

Specifically, the sensor 210 may include a position sensor 211 configured to detect whether the vacuum cleaner 100 is coupled to the docking station 200, a dust collecting bin sensor 213 configured to detect the capacity level of the dust collecting bin 15, and the collector sensor 215 configured to detect whether the collector 290 is at capacity.

The position sensor 211 according to an embodiment may detect whether the vacuum cleaner 100 is coupled to the docking station 200.

To this end, the position sensor 211 may be provided at one end of the seating portion 281 that is connected to the dust collecting bin 15 and may, in a case in which the dust collecting bin 15 is connected to the seating portion 281, output a different output value as compared to when the dust collecting bin 15 is not connected to the seating portion 281.

For example, the position sensor 211 may be provided as an infrared sensor, a piezoelectric sensor, or the like, but is not limited thereto, and any other sensor may be used as the position sensor 211 as long as the sensor is able to vary output values according to whether the dust collecting bin 15 is coupled to the seating portion 281.

Depending on the embodiment, the position sensor 211 may be omitted, and in this case, the docking station 200 may determine that the vacuum cleaner 100 is coupled to the docking station 200 when the charging terminal of the vacuum cleaner 100 is electrically connected to the charger 270.

The dust collecting bin sensor 213 according to an embodiment may detect the capacity level of the dust collecting bin 15.

To this end, the dust collecting bin sensor 213 may be provided at one side of the seating portion 281 and may be provided as a camera sensor, an ultrasonic sensor, or the like to output different values according to the capacity level of the dust collecting bin 15.

However, the dust collecting bin sensor 213 is not limited to the above examples and may also be provided as a sensor, such as a current sensor and a Hall sensor, that is able to detect an operational change of the second motor 251 due to the capacity level of the dust collecting bin 15.

In this way, the position and type of the dust collecting bin sensor 213 are not limited and may vary as long as the sensor is able to detect a capacity level of the dust collecting bin 15.

The collector sensor 215 according to an embodiment may detect whether the collector 290 is at capacity.

For example, the collector sensor 215 may be provided as a pressure sensor, and in a case in which the collector 290 is filled to capacity and interferes with a suctioning air flow of the second suction device 250, the collector sensor 215 may detect a pressure different from a pressure at the time of normal operation. In this way, in the case in which the collector sensor 215 outputs a pressure different from a pressure at the time of normal operation, the controller 240 may determine that the collector 290 is at capacity.

However, the collector sensor 215 is not limited to the above example and may be any other type of sensor, such as a light sensor or a camera, that is able to detect capacity of the collector 290.

The communication interface 220 according to an embodiment may perform communication with an external electronic device. Specifically, the communication interface 220 may transmit and receive information to and from the vacuum cleaner 100 and a user terminal through wireless communication. To this end, the communication interface 220 may be configured as a wireless communication module that uses a known type of wireless communication protocol.

The input device 230 according to an embodiment may receive an input from a user.

To this end, the input device 230 may be provided in the main body 201 of the docking station 200 and may be implemented using a physical button, a switch, a knob, a touch pad, or the like.

For example, the input device 230 may be provided at an upper side of the docking station 200 and may be provided as a button or a switch. However, the position and type of the input device 230 are not limited as long as the input device 230 is able to receive a user input.

Specifically, the input device 230 may receive an operation command or a stop command relating to the discharge operation for removing foreign matter from inside the dust collecting bin 15.

Also, depending on the embodiment, the input device 230 may include the input member 235 which is connected to the opening member 283 provided at the opening guide 282 and a sensor (e.g., a piezoelectric sensor or the like) which is configured to detect the position of the input member 235.

Here, the position of the opening member 283 may be changed according to an input provided through the input member 235. That is, by changing the position of the opening member 283 through the input member 235, the dust collecting bin door 19 of the dust collecting bin 15 may automatically be opened or the dust collecting bin door 19 of the dust collecting bin 15 may be manually opened.

Specifically, the input member 235 may be formed in the shape of a bar that includes one end which is connected to the opening member 283 provided at the opening guide 282 and the other end which protrudes to an upper side of the main body 201.

By an input through the input member 235, the opening member 283 may be provided at the position opening of the dust collecting bin door 19, thus inputting a command for the discharge operation.

For example, a user U may move the position of the input member 235 downward or upward to cause the opening member 283 to move downward or upward. Here, through the movement, the opening member 283 may be disposed at the first position at which the opening member 283 presses the fixing member 21 of the dust collecting bin 15 or may be disposed at the second position at which the opening member 283 is spaced apart from the fixing member 21 of the dust collecting bin 15.

That is, when the vacuum cleaner 100 is coupled to the docking station 200 in a state in which the opening member 283 is disposed at the first position, the dust collecting bin door 19 may be automatically opened. Also, when the vacuum cleaner 100 is coupled to the docking station 200 in a state in which the opening member 283 is disposed at the second position, the dust collecting bin door 19 may not be opened, and the dust collecting bin door 19 may be opened only in a case in which the opening member 283 moves to the first position according to an input of the user U.

When the vacuum cleaner 100 is coupled to the docking station 200, that is, the charging terminal of the vacuum cleaner 100 is electrically connected to the charger 270, the controller 240 according to an embodiment may control the discharge operation removing the foreign matter from inside the dust collecting bin 15.

Specifically, the controller 240 may control the second suction device 250 to supply a suctioning air flow to the dust collecting bin 15 and perform the discharge operation.

Depending on the embodiment, the controller 240 may operate only the second suction device 250, without operation of the first suction device 150, to perform the discharge operation or may operate both the first suction device 150 and the second suction device 250 to perform the discharge operation.

When operating only the second suction device 250, without operating the first suction device 150, to perform the discharge operation, the controller 240 may control the second suction device 250 to periodically change a suction force while performing the discharge operation.

Here, controlling the suction force of the second suction device 250 to be periodically changed may include controlling the second suction device 250 to periodically repeat being turned on and off and controlling the second suction device 250 to periodically change the rotational speed.

That is, by controlling the power supplied to the second suction device 250 so that the second suction device 250 is periodically turned on and off, the controller 240 may control the second suction device 250 to periodically repeat being turned on and off.

Also, by controlling the power supplied to the second suction device 250 so that the second suction device 250 periodically changes the rotational speed, the controller 240 may control the second suction device 250 to periodically change the rotational speed.

When operating both the first suction device 150 and the second suction device 250 to perform the discharge operation, the controller 240 may, while controlling the second suction device 250, control the communication interface 220 to transmit a control command to the vacuum cleaner 100, thus performing the discharge operation.

Conversely, depending on the embodiment, the controller 240 may receive a control command from the vacuum cleaner 100 and may, according to the received control command, control the second suction device 250 to perform the discharge operation.

Here, the second suction device 250 may include the second motor 251 configured to operate according to control of the controller 240 and the second suction fan 253 configured to receive a rotational force from the second motor 251 and rotate, thus supplying a suctioning air flow to the dust collecting bin 15.

Specifically, the controller 240 may control the second suction device 250 to operate and control the first suction device 150 to operate in the state in which the second suction device 250 operates. Specifically, the controller 240 may, while controlling the second suction device 250 so that the second suction device 250 operates, control the communication interface 220 to transmit to the vacuum cleaner 100 a control command for operation of the first suction device 150.

For example, the controller 240 may control the second suction device 250 to be turned on and control the communication interface 220 so that a control command for the first suction device 150 to periodically change a suction force is transmitted to the vacuum cleaner 100.

Also, the controller 240 may control the communication interface 220 and the second suction device 250 so that the first suction device 150 and the second suction device 250 operate alternately with each other.

Also, the controller 240 may control the second suction device 250 to periodically change a suction force and control the communication interface 220 so that a control command for the first suction device 150 to be turned on is transmitted to the vacuum cleaner 100.

In this way, when the vacuum cleaner 100 is coupled to the docking station 200, the controller 240 may solely operate the second suction device 250 or operate both the first suction device 150 and the second suction device 250 in order to perform the discharge operation.

However, depending on the embodiment, in the case in which the vacuum cleaner 100 is coupled to the docking station 200, the controller 240 may determine whether to perform the discharge operation. Also, upon deciding to perform the discharge operation, the controller 240 may control the communication interface 220 and the second suction device 250 so that the first suction device 150 and the second suction device 250 start to operate.

That is, depending on the embodiment, the controller 240 may not perform the discharge operation when not necessary, even in the case in which the vacuum cleaner 100 is coupled to the docking station 200. In this way, the controller 240 may prevent unnecessary power consumption and noise generation.

For example, the controller 240 may determine to perform the discharge operation upon determining, based on an output of the dust collecting bin sensor 213, that the capacity level of the dust collecting bin 15 is a predetermined value or more. However, depending on the embodiment, the controller 240 may also determine whether to perform the discharge operation based on an output of the dust collecting bin sensor 120 of the vacuum cleaner 100 that is received through the communication interface 220.

The controller 240 may also determine whether to perform the discharge operation based on a user input.

For example, the controller 240 may determine to perform the discharge operation upon receiving a discharge operation start command from a user terminal through the communication interface 220.

Also, for example, the controller 240 may determine to perform the discharge operation upon receiving the discharge operation start command as an input from the user through the input device 230. Here, in a case in which the input device 230 includes the input member 235 depending on the embodiment, the controller 240 may determine to perform the discharge operation when the opening member 283 is placed at the position opening the dust collecting bin door 19 (the position pressing the fixing member 21 of the dust collecting bin 15) due to a user input on the input member 235.

Also, in the embodiment in which a control command is received from the vacuum cleaner 100, the controller 240 may receive a control command relating to operation of the second suction device 250 from the vacuum cleaner 100 through the communication interface 220.

In this case, the controller 240 may control the second suction device 250 to operate.

In this way, the cleaning device 1 may operate the first suction fan 153 in a state in which the second suction fan 253 operates, thus periodically changing a flow rate of a suctioning air flow supplied to the dust collecting bin 15.

As directions of air flows instantaneously change, some of the foreign matter having resistance against a specific direction may lose the resistance due to air flowing in another direction and may be detached to the outside of the dust collecting bin 15 along with the air flow.

That is, the docking station 200 may transmit a control command to the vacuum cleaner 100 or receive a control command from the vacuum cleaner 100 to make the first suction device 150 operate in a state in which the second suction device 250 operates, thus performing the discharge operation.

In the case in which the docking station 200 includes the door driver 260, the controller 240 according to an embodiment may control the door driver 260 so that the dust collecting bin 15 is closed by the dust collecting bin door 19 upon an end of the discharge operation.

The door driver 260 may be provided to press the dust collecting bin door 19. For example, the door driver 260 may be provided at one side of the seating portion 281 and may include the pressing member 263 which is configured to press the dust collecting bin door 19 detached from the dust collecting bin 15 and the actuator 261 which is configured to extend the pressing member 263.

By operating the actuator 261 to extend the pressing member 263 when the discharge operation has ended according to control of the controller 240, the door driver 260 causes the dust collecting bin door 19 to be closed.

Also, in a case in which the vacuum cleaner 100 is coupled to the docking station 200 and the discharge operation is started, the controller 240 may control the door driver 260 to open the dust collecting bin door 19. For example, by controlling the actuator 261 to shorten the pressing member 263, the controller 240 causes the dust collecting bin door 19 to be opened. In this case, the dust collecting bin door 19 may be opened when the pressing member 263 is shortened in a state in which the fixing member 21 is pressed by the opening guide 282.

Also, upon an end of the discharge operation, the controller 240 according to an embodiment may control the communication interface 220 to transmit to the vacuum cleaner 100 a control command relating to high-speed rotation of the first suction device 150 of the vacuum cleaner 100. In this case, the strong suctioning air flow caused by the high-speed rotation of the first suction device 150 may cause the dust collecting bin door 19 to be closed, thus causing the dust collecting bin 15 to be closed.

In this way, using the door driver 260 or the first suction device 150, the cleaning device 1 may allow the dust collecting bin door 19 to be closed, which causes the dust collecting bin 15 to be closed, upon an end of the discharge operation.

In this way, even when the user separates the vacuum cleaner 100 from the docking station 200, the user may be provided with a state in which the dust collecting bin door 19 is closed. Thus, without a separate additional operation, the user may use the vacuum cleaner 100 to perform cleaning.

When the vacuum cleaner 100 is coupled to the docking station 200, the controller 240 according to an embodiment may control the charger 270 to supply power to the battery 16.

That is, the charger 270 may include the charging terminal 275 configured to come into contact with the charging terminal of the vacuum cleaner 100 when the vacuum cleaner 100 is coupled to the docking station 200, and by supplying power through the charging terminal 275, the charger 270 may charge the battery 16 of the vacuum cleaner 100.

In this way, the docking station 200 may be provided to supply power to the battery 16 when the vacuum cleaner 100 is docked at the docking station 200. Also, as described above, the docking station 200 may automatically discharge dust collected inside the dust collecting bin 15 when the vacuum cleaner 100 is docked at the docking station 200, thus increasing consumer convenience.

However, depending on the embodiment, the docking station 200 may perform only the discharge operation automatically discharging the dust collected in the dust collecting bin 15, without performing charging of the vacuum cleaner 100.

The controller 240 according to an embodiment may determine that the vacuum cleaner 100 is coupled to the docking station 200 when the charging terminal of the vacuum cleaner 100 is electrically connected to the charger 270. That is, in a case in which the charging terminal 275 of the charger 270 and the charging terminal of the vacuum cleaner 100 come into contact and the charging terminal of the vacuum cleaner 100 is electrically connected to the charger 270, the controller 240 may, based on a result of detecting a load change of the charger 270, determine that the vacuum cleaner 100 is coupled to the docking station 200.

The controller 240 according to an embodiment may, based on an output of the collector sensor 215, determine whether the collector 290 is filled to capacity and may control the display 280 to display the capacity of the collector 290 in a case in which the collector 290 is at capacity.

For example, the controller 240 may control the display 280 to output the first light (e.g., blue light) in a case in which the collector 290 is not at capacity. Also, the controller 240 may control the display 280 to output the second light (e.g., red light) in the case in which the collector 290 is filled to capacity and may control the display 280 to continue outputting the second light (e.g., red light) until the dust bag 293 of the collector 290 is replaced.

Here, the display 280 may display an operational state of the docking station 200.

For example, the display 280 may correspond to an LED panel configured to irradiate light and may be provided on a front surface of the docking station 200 to irradiate the outside of the docking station 200 with light.

Depending on the embodiment, the display 280 may further include an inner display which is provided in the seating portion 281 to irradiate the dust collecting bin 15 with light from inside the seating portion 281. In this case, in the case in which the collector 290 is at capacity, the cleaning device 1 may control the inner display to display the capacity of the collector 290. Specifically, the controller 240 may control the inner display to output the first light (e.g., blue light) in the case in which the collector 290 is not at capacity. Also, the controller 240 may control the inner display to output the second light (e.g., red light) in the case in which the collector 290 is filled to capacity and may control the inner display to continue outputting the second light (e.g., red light) until the dust bag 293 of the collector 290 is replaced.

However, the position and type of the display 280 are not limited thereto and may vary as long as the display 280 is able to display the operational state.

Also, the controller 240 according to an embodiment may, based on an output of the collector sensor 215, determine whether the collector 290 is filled to capacity and may control the communication interface 220 to transmit notification information relating to the capacity of the collector 290 to a user terminal in a case in which the collector 290 is at capacity.

In this way, in the case in which the collector 290 is at capacity, the docking station 200 may perform at least one of an operation controlling the display 280 to display the notification information or an operation controlling the communication interface 220 to transmit the notification information to the user terminal, thus informing the user of the capacity of the collector 290.

The controller 240 may include at least one memory configured to store a program for performing the above-described operations and operations described below and at least one processor configured to execute the stored program. In a case in which a plurality of memories and a plurality of processors are provided, the plurality of memories and plurality of processors may be integrated into a single chip or may be provided at physically isolated locations.

Control flows of the vacuum cleaner 100 and the docking station 200 have been described above. Hereinafter, the cleaning device 1 performing the discharge operation discharging foreign matter from inside the dust collecting bin 15 will be described in more detail.

FIG. 13 is a view for describing a case in which the cleaning device 1 performs control according to an external state according to an embodiment of the disclosure.

Basically, depending on the embodiment, the cleaning device 1 may determine to perform the discharge operation in the case in which the vacuum cleaner 100 is coupled to the docking station 200. That is, in the case in which the vacuum cleaner 100 is coupled to the docking station 200, the docking station 200 may perform the discharge operation and charging unconditionally. Specifically, for example, the controller 240 may start the discharge operation in the case in which the charging terminal of the vacuum cleaner 100 is electrically connected to the charger 270.

However, depending on the embodiment, in the case in which the vacuum cleaner 100 is coupled to the docking station 200, the cleaning device 1 may, based on various pieces of information, determine whether to perform the discharge operation.

Referring to FIG. 13, the cleaning device 1 according to an embodiment may perform the discharge operation when a discharge command is input in a state in which the vacuum cleaner 100 is coupled to the docking station 200 or when the capacity level of the dust collecting bin 15 is a predetermined value (a first set value) or more.

The cleaning device 1 may perform the discharge operation when, in a state in which the vacuum cleaner 100 is coupled to the docking station 200, the cleaning device 1 receives a discharge operation start command from a user terminal or receives the discharge operation start command as an input from the user U through the operation panel 17 of the vacuum cleaner 100 or through the input device 230 of the docking station 200.

Specifically, the vacuum cleaner 100 may determine to perform the discharge operation upon receiving the discharge operation start command from the user terminal through the communication interface 130. The docking station 200 may determine to perform the discharge operation upon receiving the discharge operation start command from the user terminal through the communication interface 220.

The vacuum cleaner 100 may determine to perform the discharge operation upon receiving information, which indicates that the discharge operation start command has been received as an input through the input device 230, from the docking station 200 through the communication interface 130. The docking station 200 may determine to perform the discharge operation upon receiving the discharge operation start command as an input through the input device 230.

Here, in a case in which the input device 230 includes the input member 235 depending on the embodiment, the docking station 200 may determine to perform the discharge operation when the opening member 283 is placed at the position opening the dust collecting bin door 19 (the position pressing the fixing member 21 of the dust collecting bin 15) due to an input provided on the input member 235.

Also, the cleaning device 1 may perform the discharge operation when, in a state in which the vacuum cleaner 100 is coupled to the docking station 200, the capacity level of the dust collecting bin 15 is determined as the predetermined value (the first set value) or more through the dust collecting bin sensor 120 of the vacuum cleaner 100 or the dust collecting bin sensor 213 of the docking station 200. That is, the cleaning device 1 may determine to perform the discharge operation only when the capacity level of the dust collecting bin 15 is a set value or more and thus it is necessary to discharge foreign matter from inside the dust collecting bin 15.

Specifically, the vacuum cleaner 100 may determine to perform the discharge operation upon determining, based on an output of the dust collecting bin sensor 120, that the capacity level of the dust collecting bin 15 is the predetermined value (the first set value) or more. However, depending on the embodiment, the vacuum cleaner 100 may also determine whether to perform the discharge operation based on an output of the dust collecting bin sensor 213 of the docking station 200 that is received through the communication interface 130.

Also, the docking station 200 may determine to perform the discharge operation upon determining, based on an output of the dust collecting bin sensor 213, that the capacity level of the dust collecting bin 15 is a predetermined value or more. However, depending on the embodiment, the docking station 200 may also determine whether to perform the discharge operation based on an output of the dust collecting bin sensor 120 of the vacuum cleaner 100 that is received through the communication interface 220.

Here, when not performing the discharge operation, the cleaning device 1 may perform charging of the battery 16 of the vacuum cleaner 100. However, depending on the embodiment, even while performing the discharge operation, the cleaning device 1 may perform charging of the battery 16 of the vacuum cleaner 100 in a state in which the first suction device 150 of the vacuum cleaner 100 is turned off.

In other words, when a discharge command is not input in a state in which the vacuum cleaner 100 is coupled to the docking station 200 or when the capacity level of the dust collecting bin 15 is less than the predetermined value (the first set value), the cleaning device 1 may only perform charging of the battery 16 of the vacuum cleaner 100 without performing the discharge operation. That is, depending on the embodiment, the cleaning device 1 may not perform the discharge operation when not necessary, even in the case in which the vacuum cleaner 100 is coupled to the docking station 200. In this way, the cleaning device 1 may prevent unnecessary power consumption and noise generation.

Here, the cleaning device 1 may stop the discharge operation or charging when the vacuum cleaner 100 is separated from the docking station 200.

The content relating to the cleaning device 1 performing control according to an external state has been described above. Hereinafter, the cleaning device 1 performing the discharge operation will be described in more detail.

Figure 14:
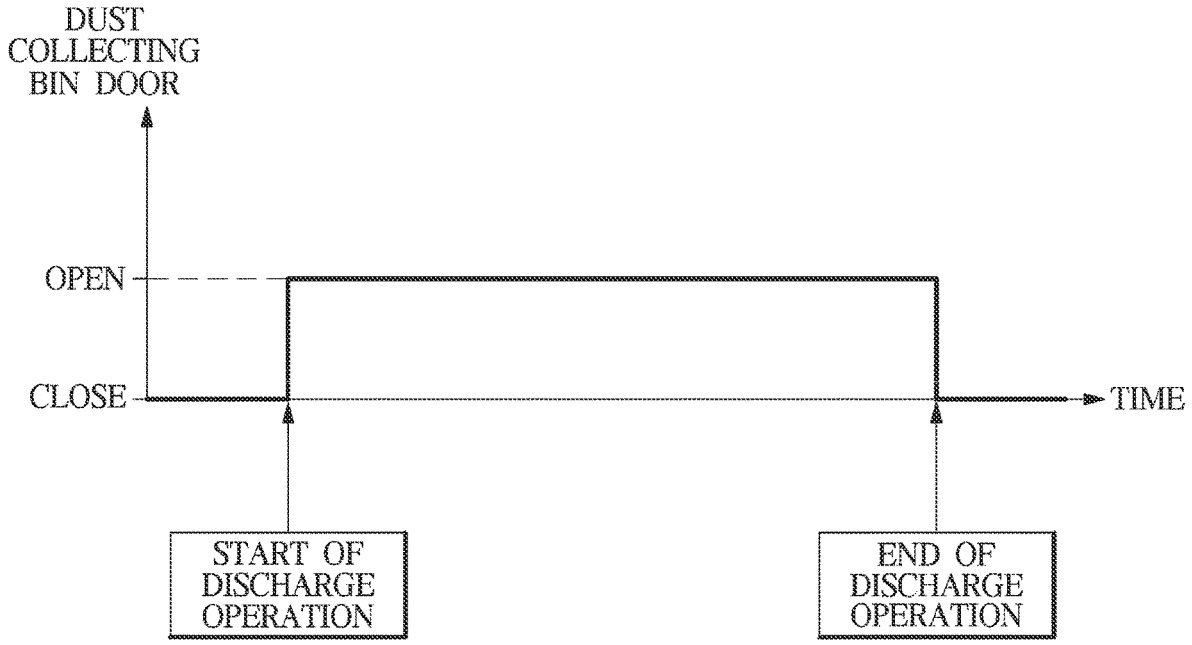
FIG. 14 is a view for describing opening and closing of the dust collecting bin door in a case in which the cleaning device performs the discharge operation according to an embodiment of the disclosure.

FIG. 14 is a view for describing opening and closing of the dust collecting bin door 19 in a case in which the cleaning device 1 performs the discharge operation according to an embodiment of the disclosure. FIGS. 15 to 19 are views illustrating supply of power to the suction devices 150 and 250 in the case in which the cleaning device 1 performs the discharge operation according to various embodiments of the disclosure.

Referring to FIG. 14, the docking station 200 according to an embodiment may control the door driver 260 to open the dust collecting bin door 19 upon determining to start the discharge operation.

For example, the docking station 200 may control the door driver 260 to open the dust collecting bin door 19 when the charging terminal of the vacuum cleaner 100 is electrically connected to the charger 270 and may control the second suction device 250 to supply a suctioning air flow to the dust collecting bin 15 and perform the discharge operation when the dust collecting bin door 19 is opened.

As described above, even when the docking station 200 has determined that the charging terminal of the vacuum cleaner 100 is electrically connected to the charger 270 and the vacuum cleaner 100 is coupled to the docking station 200, the docking station 200 may determine whether to start the discharge operation by further taking into consideration the capacity level of the dust collecting bin 15 or a user input.

Also, depending on the embodiment, the dust collecting bin door 19 may be automatically opened when the vacuum cleaner 100 is coupled to the docking station 200, and in this case, an operation in which the docking station 200 controls the door driver 260 to open the dust collecting bin door 19 may be omitted.

The docking station 200 according to an embodiment may control the door driver 260 to close the dust collecting bin door 19 upon determining to end the discharge operation.

For example, the docking station 200 may determine to end the discharge operation upon a discharge time elapsing after the start of the discharge operation. Also, depending on the embodiment, even before the elapse of the discharge time, the docking station 200 may determine to end the discharge operation when a stop command is input or the vacuum cleaner 100 is separated from the docking station 200. Also, depending on the embodiment, the docking station 200 may determine to end the discharge operation when the capacity level of the dust collecting bin 15 is less than a predetermined value (a second set value).

Also, depending on the embodiment, upon determining to end the discharge operation, the docking station 200 may transmit to the vacuum cleaner 100 a control command for the first suction device 150 of the vacuum cleaner 100 to rotate at a high speed.

In this way, the docking station 200 may open or close the dust collecting bin door 19 upon the start and end of the discharge operation. Hereinafter, supplying irregular suctioning air flows during the discharge operation will be described in detail.

The cleaning device 1 according to an embodiment may, upon determining to perform the discharge operation, control the second suction device 250 of the docking station 200 to operate.

However, when the second suction device 250 is kept turned on and thus the same suctioning air flow is supplied to the dust collecting bin 15, some of the foreign matter may be caught at an inner configuration of the dust collecting bin 15 and not be discharged to the outside. For example, foreign matter such as hair may be caught at an inner configuration of the dust collecting bin 15 and, despite the suctioning air flow, remain inside the dust collecting bin 15 instead of being detached to the outside of the dust collecting bin 15. That is, the suctioning air flow delivered to the inside of the dust collecting bin 15 may be formed to be directed only in the same direction. Accordingly, some of the foreign matter may have resistance against the direction in which the suctioning air flow is formed and may not be detached to the outside of the dust collecting bin 15 despite the suctioning air flow. Therefore, a problem may occur in that foreign matter inside the dust collecting bin 15 is not effectively discharged.

The cleaning device 1 according to an embodiment may control the second suction device 250 to periodically change a suction force while performing the discharge operation, thus allowing the suctioning air flow according to the operation of the second suction device 250 to vary.

Figure 15:
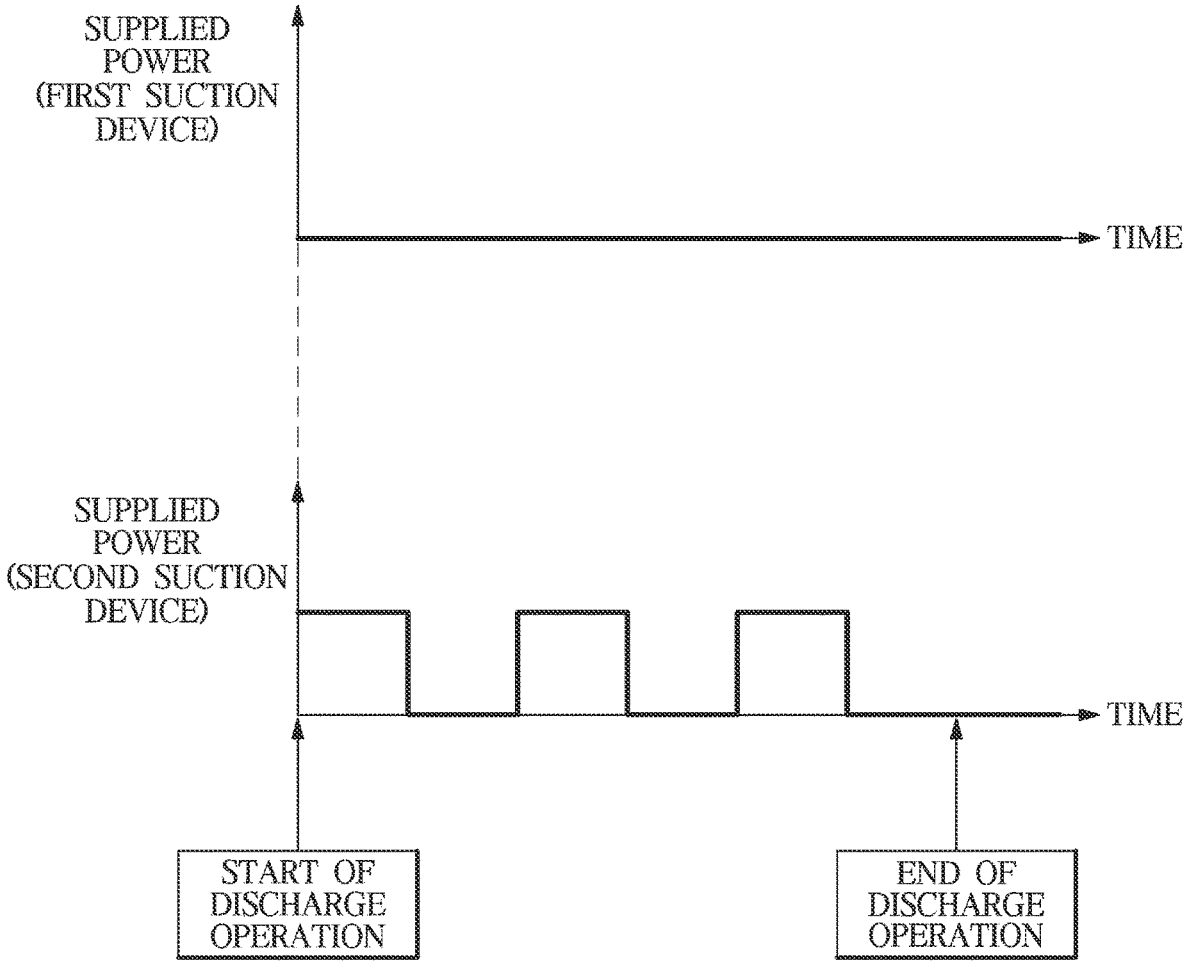
FIGS. 15, 16, 17, 18, and 19 are views illustrating supply of power to a suction device in the case in which the cleaning device performs the discharge operation according to various embodiments of the disclosure.

Referring to FIG. 15, the docking station 200 may operate only the second suction device 250, without operation of the first suction device 150, to perform the discharge operation. Here, the docking station 200 may control the second suction device 250 to periodically change a suction force while performing the discharge operation.

Here, controlling the suction force of the second suction device 250 to be periodically changed may include controlling the second suction device 250 to periodically repeat being turned on and off and controlling the second suction device 250 to periodically change the rotational speed.

That is, depending on the embodiment, by controlling the power supplied to the second suction device 250 so that the second suction device 250 is periodically turned on and off, the docking station 200 may control the second suction device 250 to periodically repeat being turned on and off. In other words, by repeating an operation of supplying power to the second suction device 250 for a predetermined amount of time and then cutting off the power supply to the second suction device 250 for a predetermined amount of time, the docking station 200 may control the second suction device 250 to periodically repeat being turned on and off.

Also, depending on the embodiment, by controlling the power supplied to the second suction device 250 so that the second suction device 250 periodically changes a rotational speed, the docking station 200 may control the second suction device 250 to periodically change the rotational speed. In other words, by repeating an operation of supplying high power to the second suction device 250 for a predetermined amount of time and then supplying low power to the second suction device 250 for a predetermined amount of time, the docking station 200 may control the second suction device 250 to periodically change the rotational speed.

That is, by making the second suction device 250 periodically change a suction force, the cleaning device 1 may change an air flow inside the dust collecting bin 15. In this way, foreign matter may be discharged more efficiently from inside the dust collecting bin 15.

Also, depending on the embodiment, by operating the first suction device 150 to change a suctioning air flow according to the operation of the second suction device 250, the cleaning device 1 may change a flow rate inside the dust collecting bin 15 and vary the air flow inside the dust collecting bin 15.

Figure 16:
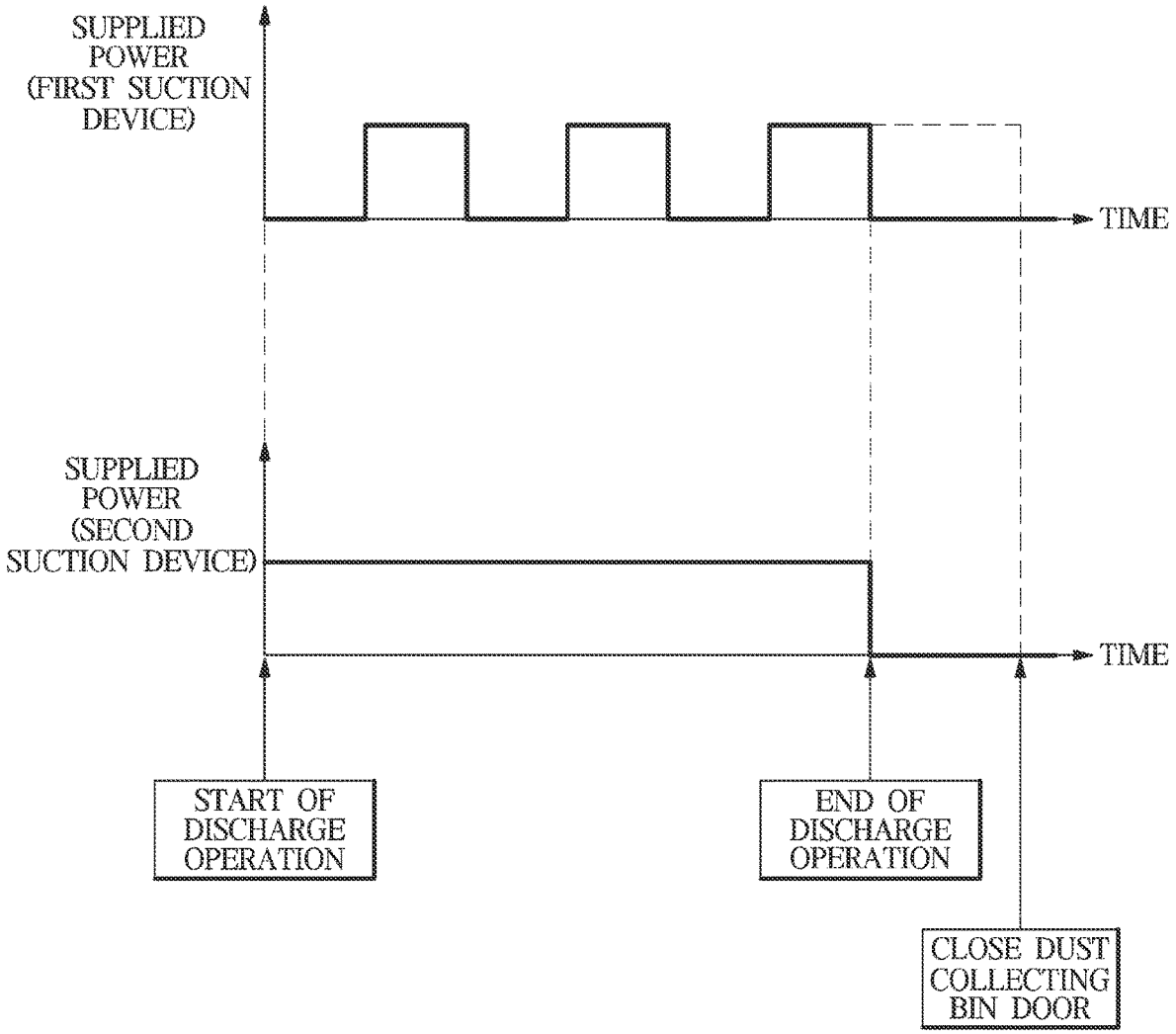

Referring to FIG. 16, the cleaning device 1 may, while performing the discharge operation, control the second suction device 250 to be turned on and the first suction device 150 to periodically change a suction force. Accordingly, upon the start of the discharge operation, power may be continuously supplied to the second suction device 250, and power may be supplied to the first suction device 150 while being periodically changed.

Here, controlling the suction force of the first suction device 150 to be periodically changed may include controlling the first suction device 150 to periodically repeat being turned on and off and controlling the first suction device 150 to periodically change the rotational speed.

That is, depending on the embodiment, by controlling the power supplied to the first suction device 150 so that the first suction device 150 is periodically turned on and off, the vacuum cleaner 100 may control the first suction device 150 to periodically repeat being turned on and off. In other words, by repeating an operation of supplying power to the first suction device 150 for a predetermined amount of time and then cutting off the power supply to the first suction device 150 for a predetermined amount of time, the vacuum cleaner 100 may control the first suction device 150 to periodically repeat being turned on and off.

Also, depending on the embodiment, by controlling the power supplied to the first suction device 150 so that the first suction device 150 periodically changes a rotational speed, the vacuum cleaner 100 may control the first suction device 150 to periodically change the rotational speed. In other words, by repeating an operation of supplying high power to the first suction device 150 for a predetermined amount of time and then supplying low power to the first suction device 150 for a predetermined amount of time, the vacuum cleaner 100 may control the first suction device 150 to periodically change the rotational speed.

To this end, upon the start of the discharge operation, the docking station 200 may, while starting power supply to the second suction device 250, transmit to the vacuum cleaner 100 a control command for periodically changing the suction force of the first suction device 150. In this case, according to the control command from the docking station 200, the vacuum cleaner 100 may periodically change the power supplied to the first suction device 150.

On the other hand, depending on the embodiment, the vacuum cleaner 100 may transmit a control command to the docking station 200, and here, upon the start of the discharge operation, the vacuum cleaner 100 may, while periodically changing the power supplied to the first suction device 150, transmit to the docking station 200 a control command relating to operation of the second suction device 250. In this case, according to the control command from the vacuum cleaner 100, the docking station 200 may supply power to the second suction device 250.

Figure 17:
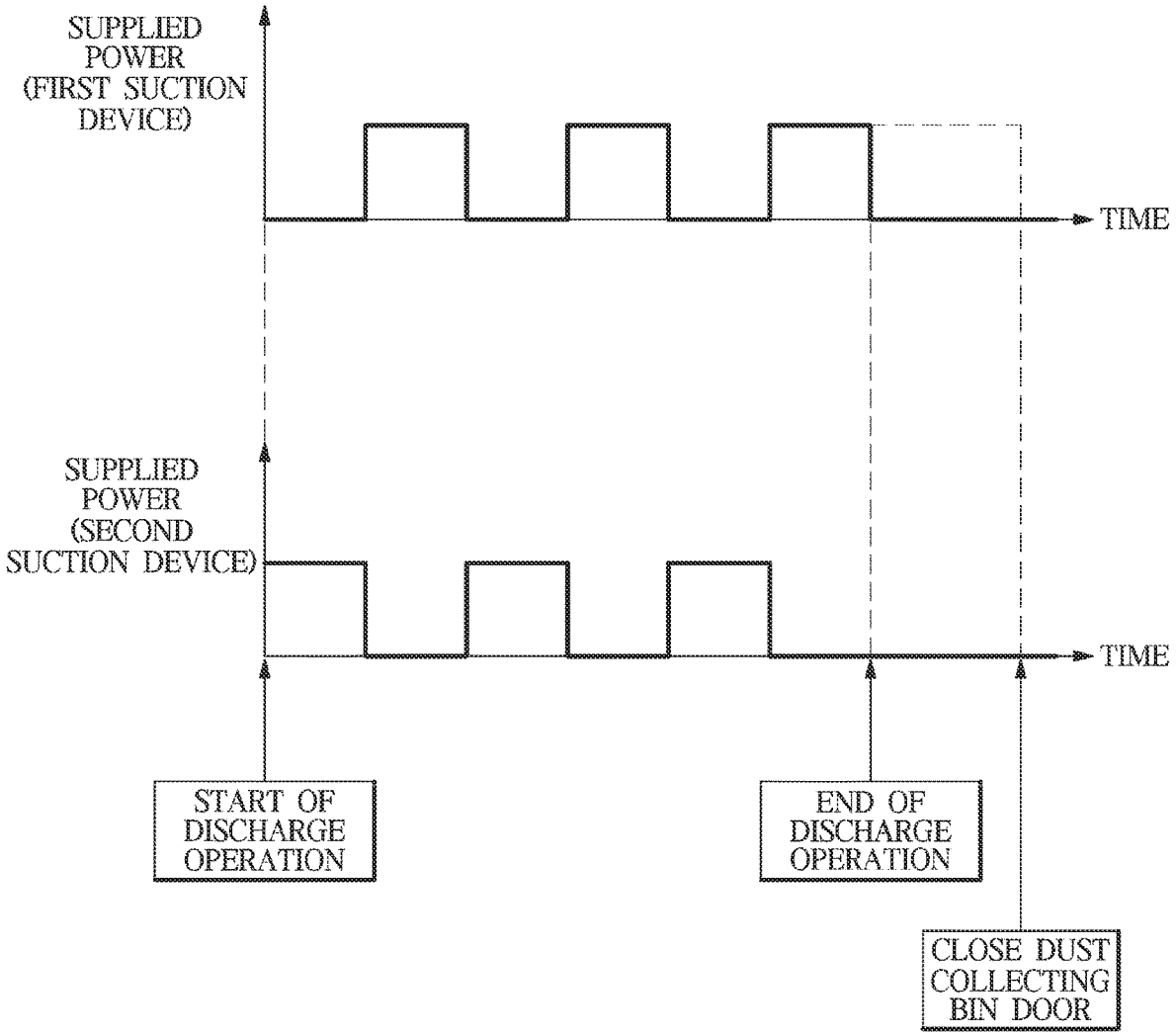

Referring to FIG. 17, while performing the discharge operation, the cleaning device 1 may control the first suction device 150 and the second suction device 250 to alternately operate. Accordingly, upon the start of the discharge operation, power may be alternately supplied to the first suction device 150 and the second suction device 250.

For example, when the power is supplied to the first suction device 150, power supply to the second suction device 250 may be cut off, or power lower than the power supplied to the first suction device 150 may be supplied to the second suction device 250. Conversely, when the power is supplied to the second suction device 250, power supply to the first suction device 150 may be cut off, or power lower than the power supplied to the second suction device 250 may be supplied to the first suction device 150.

To this end, upon the start of the discharge operation, the docking station 200 may, while periodically changing the power supplied to the second suction device 250, transmit to the vacuum cleaner 100 a control command for the first suction device 150 to operate alternately with the second suction device 250. In this case, according to the control command from the docking station 200, the vacuum cleaner 100 may periodically change the power supplied to the first suction device 150.

On the other hand, depending on the embodiment, the vacuum cleaner 100 may transmit a control command to the docking station 200, and here, upon the start of the discharge operation, the vacuum cleaner 100 may, while periodically changing the power supplied to the first suction device 150, transmit to the docking station 200 a control command for the second suction device 250 to operate alternately with the first suction device 150. In this case, according to the control command from the vacuum cleaner 100, the docking station 200 may periodically change the power supplied to the second suction device 250.

Figure 18:
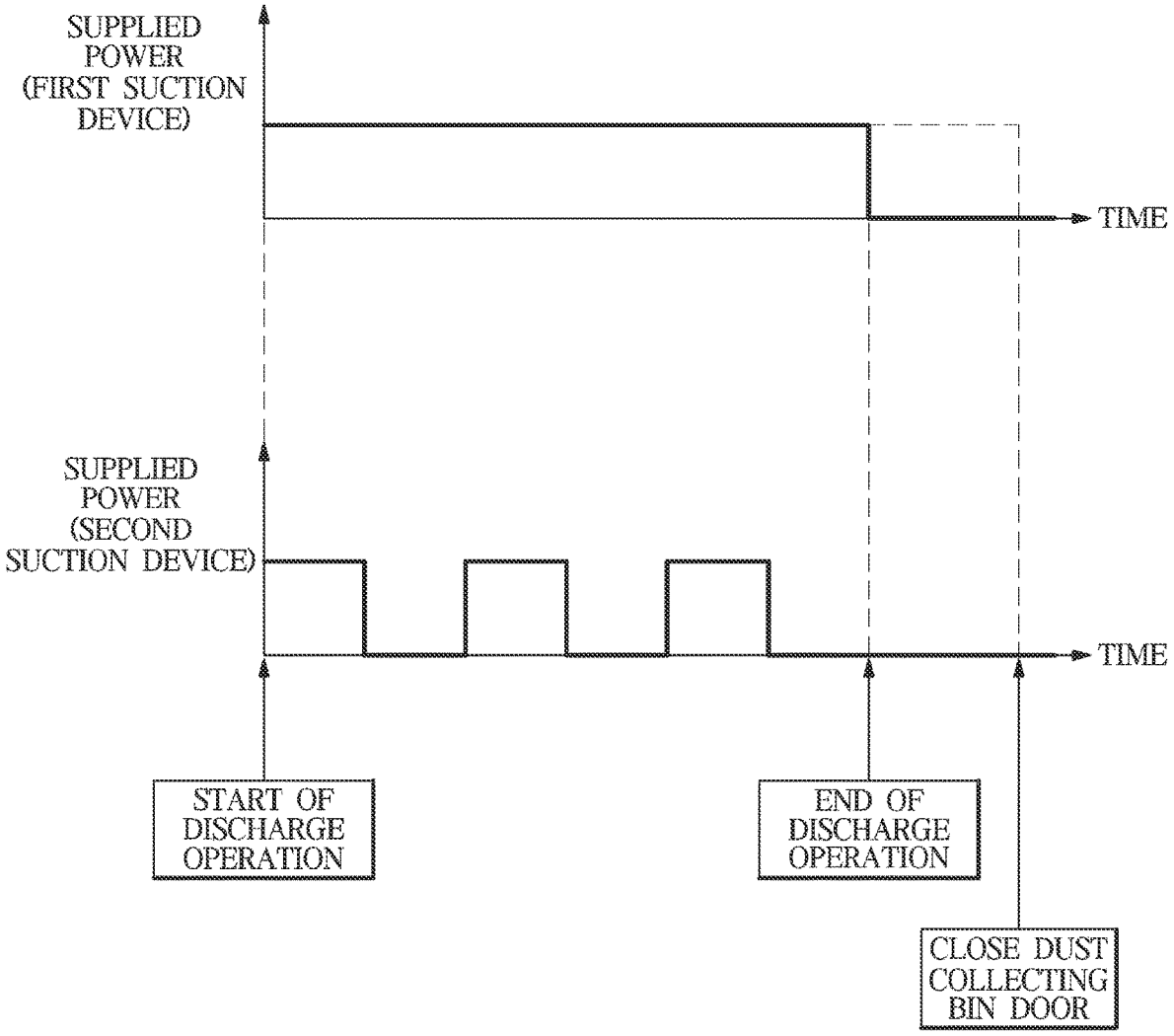

Referring to FIG. 18, while performing the discharge operation, the cleaning device 1 may control the first suction device 150 to be turned on and the second suction device 250 to periodically change a suction force. Accordingly, upon the start of the discharge operation, power may be continuously supplied to the first suction device 150, and power supplied to the second suction device 250 may be periodically changed.

Here, controlling the suction force of the second suction device 250 to be periodically changed may include controlling the second suction device 250 to periodically repeat being turned on and off and controlling the second suction device 250 to periodically change the rotational speed.

To this end, upon the start of the discharge operation, the docking station 200 may, while controlling the second suction device 250 to periodically change a suction force, transmit to the vacuum cleaner 100 a control command for the first suction device 150 to be turned on. In this case, according to the control command from the docking station 200, the vacuum cleaner 100 may supply power to the first suction device 150.

On the other hand, depending on the embodiment, the vacuum cleaner 100 may transmit a control command to the docking station 200, and here, upon the start of the discharge operation, the vacuum cleaner 100 may, while supplying power to the first suction device 150, transmit to the docking station 200 a control command for the second suction device 250 to periodically change a suction force. In this case, according to the control command from the vacuum cleaner 100, the docking station 200 may periodically change the power supplied to the second suction device 250.

In this way, in order to supply irregular suctioning air flows to the dust collecting bin 15, the cleaning device 1 may control the vacuum cleaner 100 so that the first suction device 150 of the vacuum cleaner 100 operates while the second suction device 250 operates.

That is, the cleaning device 1 may also control the first suction device 150 of the vacuum cleaner 100 coupled to the docking station 200 to operate in order to more efficiently remove the foreign matter from inside the dust collecting bin 15. In other words, the vacuum cleaner 100 and the docking station 200 may communicate with each other so that the first suction device 150 operates in a state in which the second suction device 250 operates.

A suctioning air flow formed by the first suction device 150 may be supplied to the dust collecting bin 15 and may move in a direction opposite to a direction of movement of a suctioning air flow formed by the second suction device 250. That is, while the suctioning air flow formed by the second suction device 250 may be formed in a downward direction, the suctioning air flow formed by the first suction device 150 may be formed in an upward direction.

Specifically, the first suction device 150 may rotate the first suction fan 153 to form a suctioning air flow that heads from the dust collecting bin 15 toward the outlet 13 provided in the filter housing 12.

Here, operating in a state in which the second suction device 250 operates, the first suction device 150 may periodically change a flow rate of a suctioning air flow supplied to the dust collecting bin 15.

As directions of air flows instantaneously change, some of the foreign matter having resistance against a specific direction may lose the resistance due to air flowing in another direction and may be detached to the outside of the dust collecting bin 15 along with the air flow.

Here, the foreign matter separated from the dust collecting bin 15 and discharged may move together with air due to operation of the second suction device 250 and be collected in the collector 290 provided on the suction flow path 285.

That is, by making the first suction device 150 periodically change a suction force in a state in which the second suction device 250 is turned on, making the first suction device 150 and the second suction device 250 alternately operate, or making the second suction device 250 periodically change a suction force in a state in which the first suction device 150 is turned on, the cleaning device 1 may change an air flow inside the dust collecting bin 15. In this way, foreign matter may be discharged more efficiently from inside the dust collecting bin 15. Also, as the first suction device 150 operates, the foreign matter remaining in the extension tube 20, the dust collection guide 30, and the suction unit 40 may also be gathered into the dust collecting bin 15.

In this way, using the docking station 200 configured to store or charge the vacuum cleaner 100, the cleaning device 1 allows foreign matter collected in the dust collecting bin 15 to be automatically discharged. By mounting the entire vacuum cleaner 100 on the docking station 200 without separating the dust collecting bin 15, the user may more conveniently discharge the foreign matter collected in the dust collecting bin 15.

Also, in the case in which the vacuum cleaner 100 is coupled to the docking station 200 and the discharge operation is performed, the cleaning device 1 may make the first suction device 150 of the vacuum cleaner 100 operate in a state in which the second suction device 250 of the docking station 200 operates. In this way, the cleaning device 1 may change a suctioning air flow supplied to the dust collecting bin 15 and effectively remove the collected foreign matter.

Also, depending on the embodiment, the cleaning device 1 may close the dust collecting bin door 19 upon ending the discharge operation.

For example, upon the end of the discharge operation, the cleaning device 1 may supply power to the first suction device 150 of the vacuum cleaner 100 to supply a strong suctioning air flow to the dust collecting bin door 19, thus closing the dust collecting bin door 19 as illustrated in FIGS. 16 to 18.

Specifically, the vacuum cleaner 100 may determine to end the discharge operation and may supply high power to the first suction device 150, thus controlling the first suction device 150 to rotate at a high speed. Also, depending on the embodiment, upon receiving a control command relating to high-speed rotation of the first suction device 150 from the docking station 200, the vacuum cleaner 100 may supply high power so that the first suction device 150 rotates at a high speed.

In this case, the strong suctioning air flow caused by the high-speed rotation of the first suction device 150 may cause the dust collecting bin door 19 to be closed, thus causing the dust collecting bin 15 to be closed. That is, upon an end of the discharge operation, the first suction device 150 rotates at a high speed and generates a strong suctioning air flow, thus causing the dust collecting bin door 19 to be closed. For example, the first suction device 150 rotates at a high speed and generates a strong suctioning air flow, thus causing the coupling protrusion 19*a* of the dust collecting bin door 19 to be hook-coupled to the fixing member 21 of the dust collecting bin 15. In this way, the dust collecting bin door 19 may be coupled to the lower end of the dust collecting bin 15 so that the dust collecting bin 15 is closed.

Also, depending on the embodiment, upon the end of the discharge operation, the cleaning device 1 may control the door driver 260 to close the dust collecting bin door 19. The docking station 200 may determine to end the discharge operation and may control the door driver 260 to close the dust collecting bin door 19. Also, depending on the embodiment, the docking station 200 may receive an operation command relating to the door driver 260 from the vacuum cleaner 100 and may control the door driver 260 to close the dust collecting bin door 19.

In this way, using the door driver 260 or the first suction device 150, the cleaning device 1 may allow the dust collecting bin door 19 to be closed, which causes the dust collecting bin 15 to be closed, upon the end of the discharge operation.

In this way, even when the user separates the vacuum cleaner 100 from the docking station 200, the user may be provided with a state in which the dust collecting bin door 19 is closed. Thus, without a separate additional operation, the user may use the vacuum cleaner 100 to perform cleaning.

Figure 19:
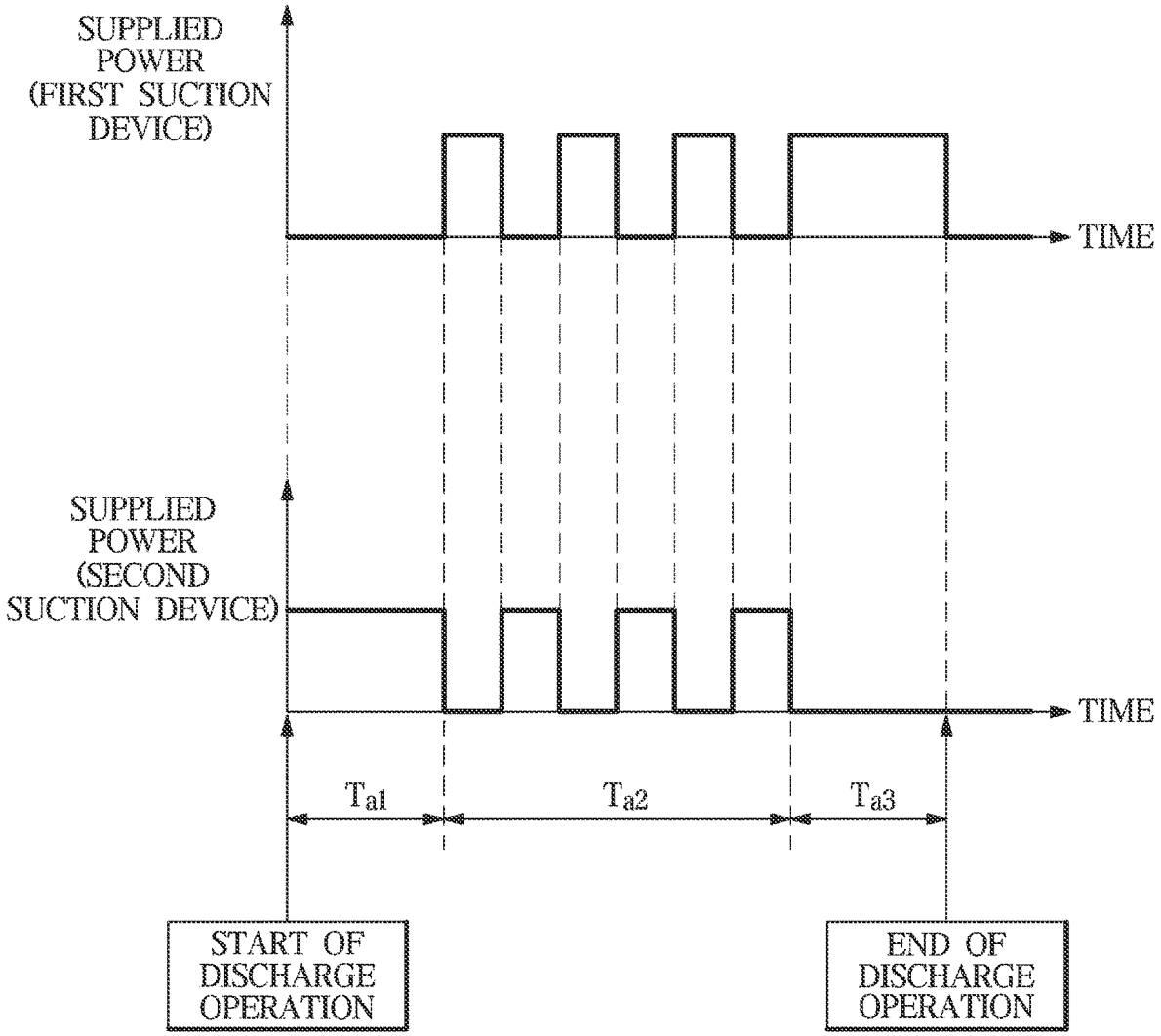

Also, the cleaning device 1 according to an embodiment may, as illustrated in FIG. 19, control the second suction device 250 to be continuously turned on for a predetermined amount of time Ta1 before the first suction device 150 or the second suction device 250 is controlled to irregularly provide suctioning air flows.

In this case, the second suction device 250 may solely operate without operation of the first suction device 150 for the predetermined amount of time Ta1 from the start of the discharge operation. In this way, foreign matter in the dust collecting bin 15 may be discharged to the docking station 200 first.

For example, upon the start of the discharge operation, the docking station 200 may supply power to the second suction device 250 so that the second suction device 250 is continuously turned on for the predetermined amount of time Ta1. Then, as illustrated in FIG. 19, the docking station 200 may control the first suction device 150 and the second suction device 250 to alternately operate, thus providing irregular suctioning air flows to the dust collecting bin 15.

That is, after the predetermined amount of time Ta1 elapses from the start of the discharge operation, the docking station 200 may transmit a control command for operation of the first suction device 150 to the vacuum cleaner 100.

However, during a time Ta2 during which irregular suctioning air flows are provided to the dust collecting bin 15, different from FIG. 19, the first suction device 150 may periodically change a suction force in a state in which the second suction device 250 is turned on, the second suction device 250 may periodically change a suction force in a state in which the first suction device 150 is turned on, or without operation of the first suction device 150, only the second suction device 250 may periodically change a suction force.

Referring to FIG. 19, the cleaning device 1 according to an embodiment may, after controlling the first suction device 150 or the second suction device 250 to irregularly provide suctioning air flows, control the first suction device 150 to be continuously turned on for a predetermined amount of time Ta3 before the end of the discharge operation.

In this way, foreign matter that may remain between the dust collecting bin 15 and the dust collecting bin door 19 may be absorbed into the dust collecting bin 15 again. Thus, sealing between the dust collecting bin 15 and the dust collecting bin door 19 may be made complete to guarantee a suction force during the cleaning operation, and foreign matter between the dust collecting bin 15 and the dust collecting bin door 19 may be prevented from being exposed to the outside to improve user satisfaction.

For example, the docking station 200 may transmit to the vacuum cleaner 100 a control command for the first suction device 150 to continuously operate during the predetermined amount of time Ta3 before the end of the discharge operation.

Figure 20:
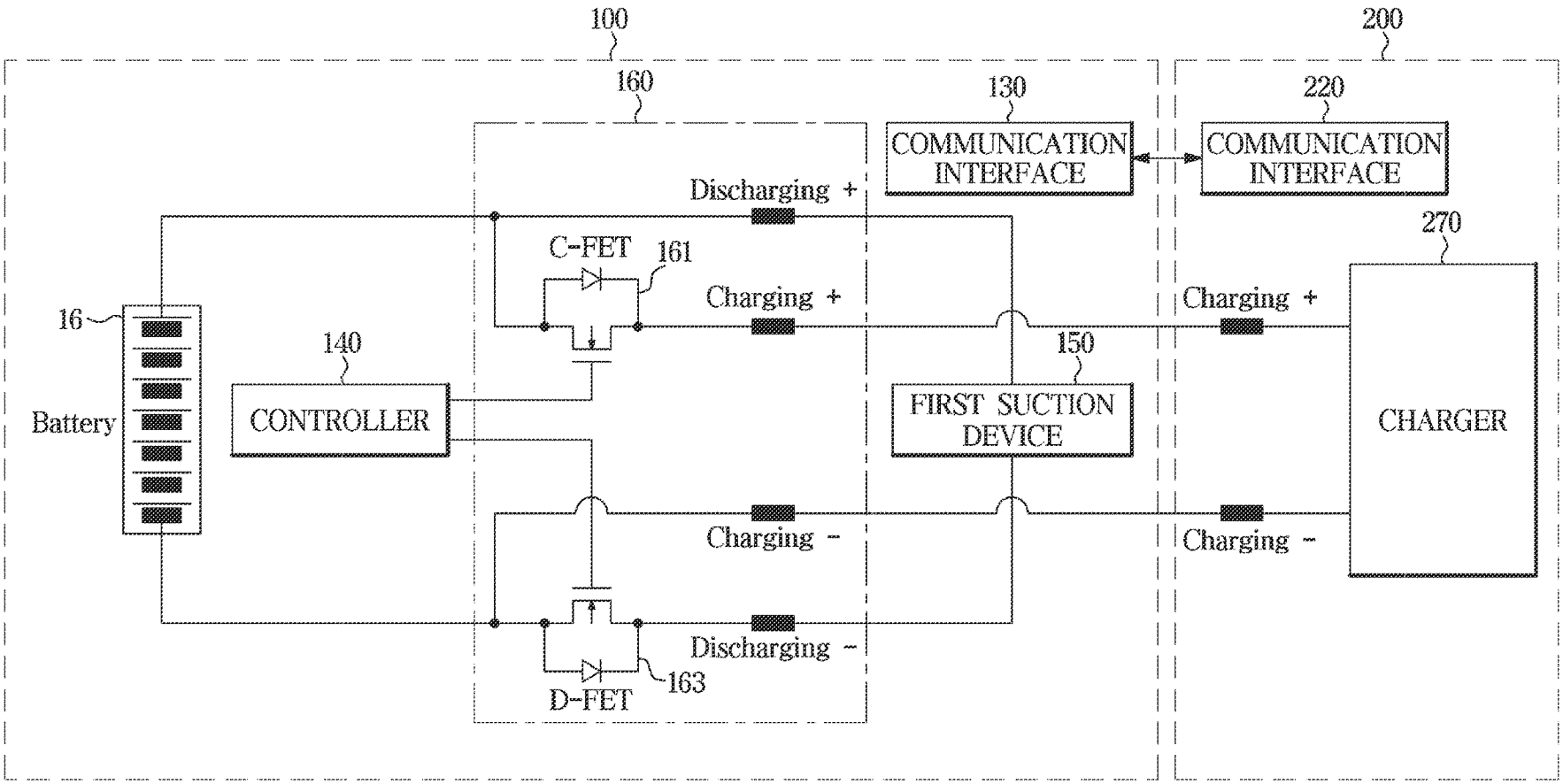
FIG. 20 is a view for describing a case in which the cleaning device charges a battery of the vacuum cleaner according to an embodiment of the disclosure.

FIG. 20 is a view for describing a case in which the cleaning device 1 charges the battery 16 of the vacuum cleaner 100 according to an embodiment of the disclosure.

Referring to FIG. 20, in the case in which the vacuum cleaner 100 is docked at the docking station 200, the controller 140 according to an embodiment may control the communication interface 130 to transmit battery charge state information to the communication interface 220 of the docking station 200. In this way, the charger 270 of the docking station 200 may supply power for fully charging the battery 16 to the vacuum cleaner 100.

Here, the controller 140 may control the charger 160 to start or end charging of the battery 16. For example, the controller 140 may control the charger 160 to not charge the battery 16 while the discharge operation is performed and the first suction device 150 operates and to charge the battery 16 while the discharge operation is not performed.

Specifically, in the case in which the vacuum cleaner 100 is seated on the docking station 200 and connected to the charging terminal 275 of the docking station 200, the charger 160 may change a first switch 161, which connects the charging terminal 275 and the battery 16, to the on-state to charge the battery 16. However, in order to supply power from the battery 16 to the first suction device 150 during the discharge operation in which the first suction device 150 operates, the charger 160 may change the first switch 161 to the off-state and change a second switch 163, which connects the battery 16 and the first suction device 150, to the on-state.

Figure 21:
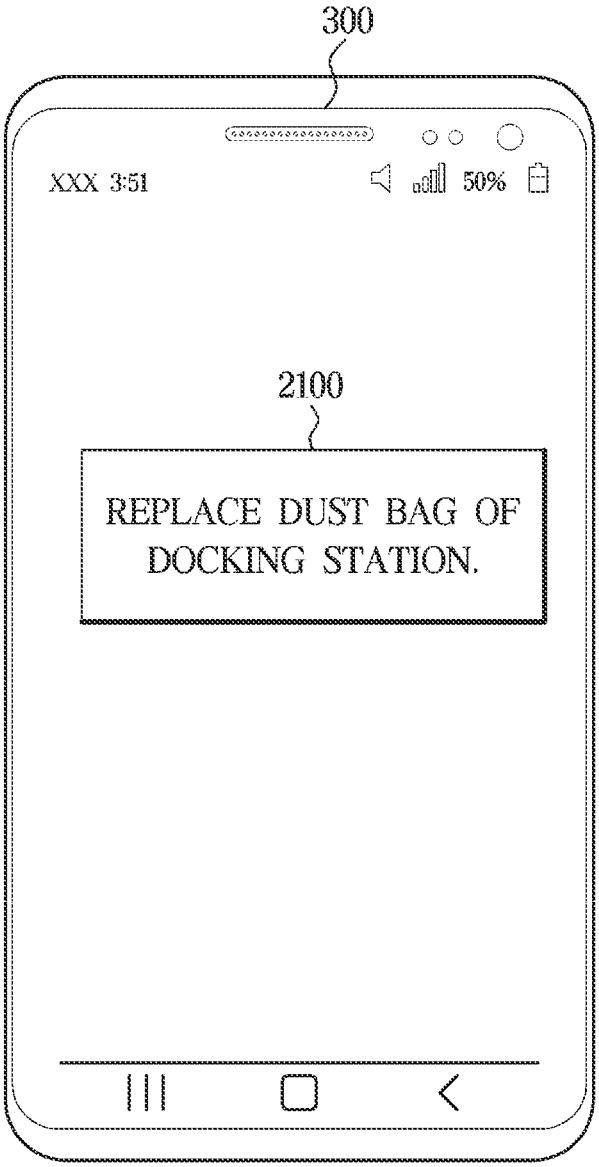
FIG. 21 is a view for describing a case in which the docking station transmits notification information relating to the capacity of the collector to a user terminal according to an embodiment of the disclosure.

FIG. 21 is a view for describing a case in which the docking station 200 transmits notification information relating to the capacity of the collector 290 to a user terminal according to an embodiment of the disclosure.

Referring to FIG. 21, in the case in which the collector 290 is at capacity, the cleaning device 1 may, in addition to controlling the display 280 to display the capacity of the collector 290, control the communication interface 220 to transmit notification information 2100 relating to the capacity of the collector 290 to a user terminal 300. In this way, as illustrated in FIG. 21, the user terminal 300 may display the notification information 2100 relating to the capacity of the collector 290.

In this way, the cleaning device 1 may inform the user of a situation in which the collector 290 is filled to capacity and thus foreign matter is not able to be normally discharged from inside the dust collecting bin 15 and may notify the user to replace the dust bag 293 of the collector 290.

Hereinafter, an embodiment relating to a control method of the cleaning device 1 according to an aspect will be described. The cleaning device 1 according to the above-described embodiments may be used in the control method of the cleaning device 1. Therefore, the descriptions given above with reference to FIGS. 1 to 21 may identically apply to the control method of the cleaning device 1.

Figure 22:
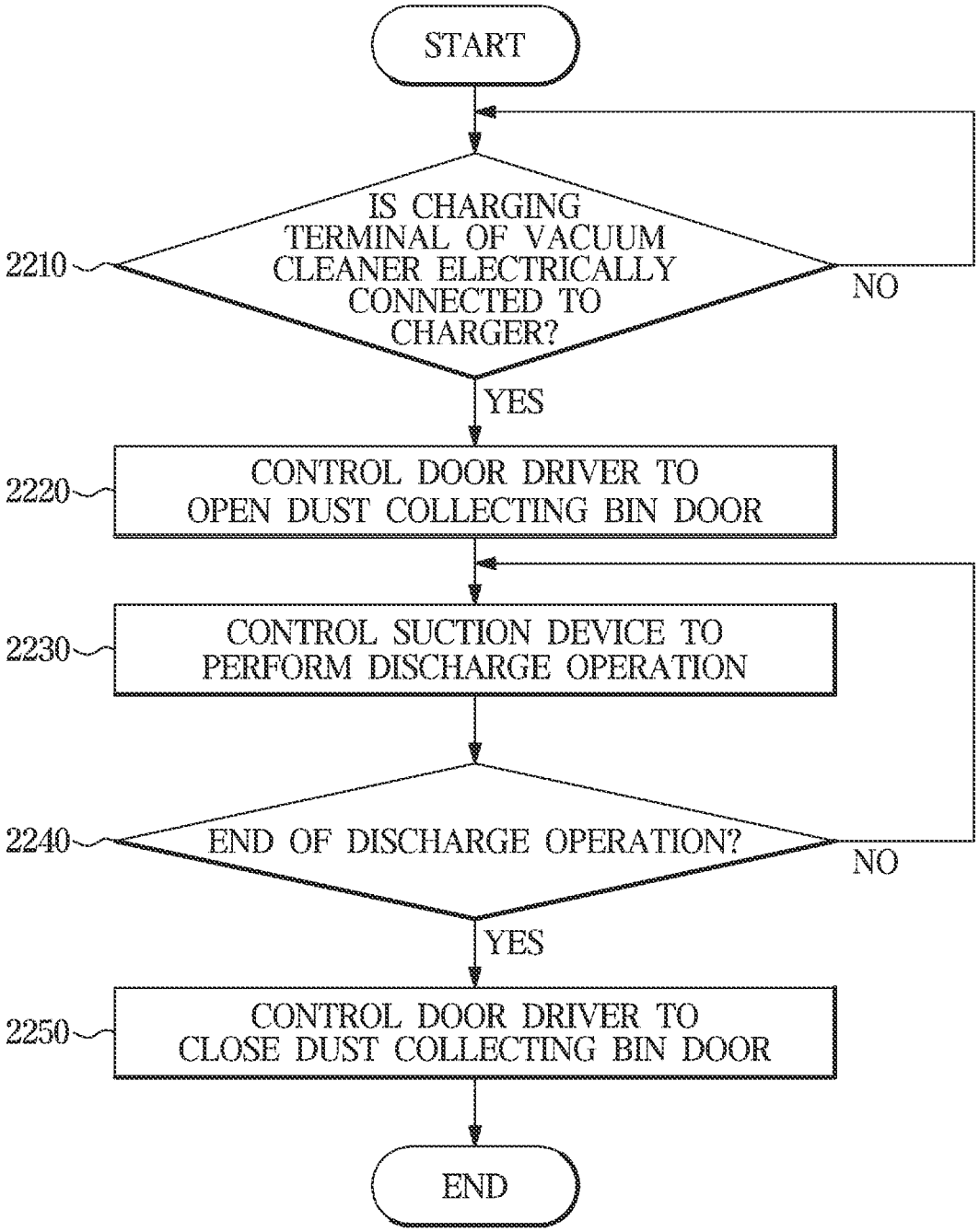
FIG. 22 is a flowchart of controlling a suction device of the docking station to perform the discharge operation in a control method of the cleaning device according to an embodiment of the disclosure.

FIG. 22 is a flowchart of controlling a suction device of the docking station to perform the discharge operation in the control method of the cleaning device according to an embodiment of the disclosure.

Referring to FIG. 22, in a case in which the charging terminal of the vacuum cleaner 100 is electrically connected to the charger 270 (YES in operation 2210), the cleaning device 1 according to an embodiment may control the door driver 260 to open the dust collecting bin door 19 (in operation 2200) and control the suction device 250 to perform the discharge operation (in operation 2230).

For example, in the case in which the charging terminal of the vacuum cleaner 100 is electrically connected to the charger 270, the docking station 200 may determine that the vacuum cleaner 100 is coupled to the docking station 200 and may open the dust collecting bin door 19 to start the discharge operation and control the second suction device 250 to provide a suctioning air flow to the dust collecting bin 15.

As described above, even when the docking station 200 has determined that the charging terminal of the vacuum cleaner 100 is electrically connected to the charger 270 and the vacuum cleaner 100 is coupled to the docking station 200, the docking station 200 may determine whether to start the discharge operation by further taking into consideration the capacity level of the dust collecting bin 15 or a user input.

Also, depending on the embodiment, the dust collecting bin door 19 may be automatically opened when the vacuum cleaner 100 is coupled to the docking station 200, and in this case, an operation in which the docking station 200 controls the door driver 260 to open the dust collecting bin door 19 may be omitted.

Here, the cleaning device 1 may control the second suction device 250 to periodically change a suction force while performing the discharge operation, thus allowing the suctioning air flow according to the operation of the second suction device 250 to vary.

Specifically, the docking station 200 may operate only the second suction device 250, without operation of the first suction device 150, to perform the discharge operation. Here, the docking station 200 may control the second suction device 250 to periodically change a suction force while performing the discharge operation.

Here, controlling the suction force of the second suction device 250 to be periodically changed may include controlling the second suction device 250 to periodically repeat being turned on and off and controlling the second suction device 250 to periodically change the rotational speed.

That is, depending on the embodiment, by controlling the power supplied to the second suction device 250 so that the second suction device 250 is periodically turned on and off, the docking station 200 may control the second suction device 250 to periodically repeat being turned on and off. In other words, by repeating an operation of supplying power to the second suction device 250 for a predetermined amount of time and then cutting off the power supply to the second suction device 250 for a predetermined amount of time, the docking station 200 may control the second suction device 250 to periodically repeat being turned on and off.

Also, depending on the embodiment, by controlling the power supplied to the second suction device 250 so that the second suction device 250 periodically changes the rotational speed, the docking station 200 may control the second suction device 250 to periodically change the rotational speed. In other words, by repeating an operation of supplying high power to the second suction device 250 for a predetermined amount of time and then supplying low power to the second suction device 250 for a predetermined amount of time, the docking station 200 may control the second suction device 250 to periodically change the rotational speed.

That is, by making the second suction device 250 periodically change a suction force, the cleaning device 1 may change an air flow inside the dust collecting bin 15. In this way, foreign matter may be discharged more efficiently from inside the dust collecting bin 15.

Also, when ending the discharge operation (YES in operation 2240), the cleaning device 1 according to an embodiment may control the door driver 260 to close the dust collecting bin door 19 (in operation 2250).

For example, the docking station 200 may determine to end the discharge operation upon a discharge time elapsing after the start of the discharge operation. Also, depending on the embodiment, even before the elapse of the discharge time, the docking station 200 may determine to end the discharge operation when a stop command is input or the vacuum cleaner 100 is separated from the docking station 200. Also, depending on the embodiment, the docking station 200 may determine to end the discharge operation when the capacity level of the dust collecting bin 15 is less than a predetermined value (a second set value).

Also, depending on the embodiment, upon determining to end the discharge operation, the docking station 200 may transmit to the vacuum cleaner 100 a control command for the first suction device 150 of the vacuum cleaner 100 to rotate at a high speed.

Figure 23:
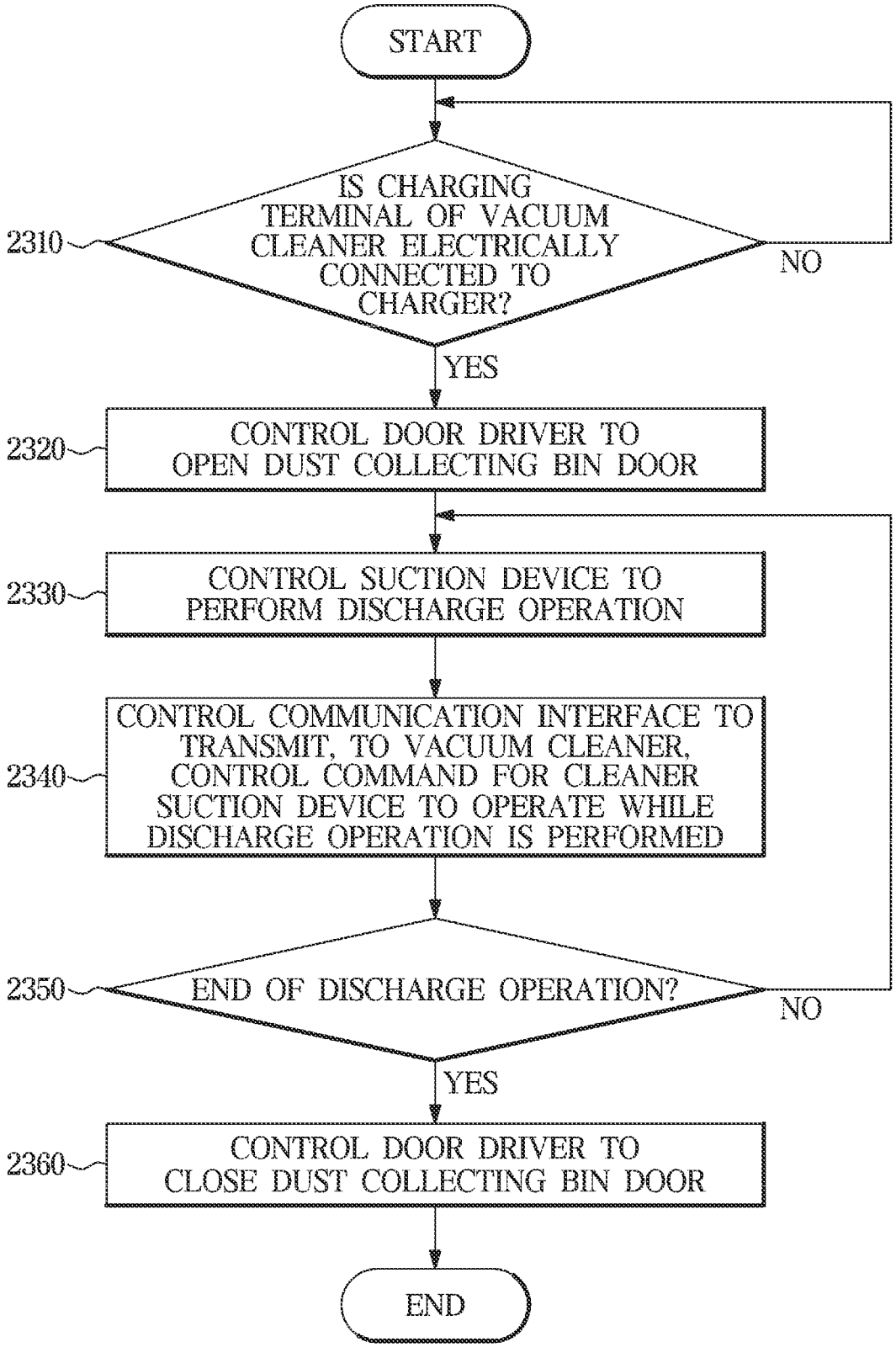
FIG. 23 is a flowchart of controlling both the suction device of the docking station and the suction device of the vacuum cleaner to perform the discharge operation in the control method of the cleaning device according to an embodiment of the disclosure.

FIG. 23 is a flowchart of controlling both the suction device 250 of the docking station 200 and the suction device 150 of the vacuum cleaner 100 to perform the discharge operation in the control method of the cleaning device 1 according to an embodiment of the disclosure.

Referring to FIG. 23, when the charging terminal of the vacuum cleaner 100 is electrically connected to the charger 270 (YES in operation 2310), the cleaning device 1 according to an embodiment may control the door driver 260 to open the dust collecting bin door 19 (in operation 2320), control the suction device 250 to perform the discharge operation (in operation 2330), and control the communication interface 220 to transmit to the vacuum cleaner 100 a control command for the cleaner suction device 150 to operate while the discharge operation is performed (in operation 2340).

For example, in the case in which the charging terminal of the vacuum cleaner 100 is electrically connected to the charger 270, the docking station 200 may determine that the vacuum cleaner 100 is coupled to the docking station 200 and may open the dust collecting bin door 19 to start the discharge operation and control the second suction device 250 to provide a suctioning air flow to the dust collecting bin 15. Meanwhile, the docking station 200 may transmit a command to operate the first suction device 150 to the vacuum cleaner 100.

As described above, even when the docking station 200 has determined that the charging terminal of the vacuum cleaner 100 is electrically connected to the charger 270 and the vacuum cleaner 100 is coupled to the docking station 200, the docking station 200 may determine whether to start the discharge operation by further taking into consideration the capacity level of the dust collecting bin 15 or a user input.

Also, depending on the embodiment, the dust collecting bin door 19 may be automatically opened when the vacuum cleaner 100 is coupled to the docking station 200, and in this case, an operation in which the docking station 200 controls the door driver 260 to open the dust collecting bin door 19 may be omitted.

By operating the first suction device 150 to change a suctioning air flow according to the operation of the second suction device 250, the cleaning device 1 may change a flow rate inside the dust collecting bin 15 and vary the air flow inside the dust collecting bin 15.

For example, depending on the embodiment, the docking station 200 may, while controlling the second suction device 250 to continuously operate, transmit to the vacuum cleaner 100 a control command for periodically changing a suction force of the first suction device 150.

Also, depending on the embodiment, the docking station 200 may, while controlling the second suction device 250 to periodically change a suction force, transmit to the vacuum cleaner 100 a control command for the first suction device 150 to continuously operate.

Also, depending on the embodiment, to cause the first suction device 150 and the second suction device 250 to alternately operate, the docking station 200 may, while controlling the second suction device 250, transmit to the vacuum cleaner 100 a control command for the first suction device 150 to operate alternately with the second suction device 250.

Also, when ending the discharge operation (YES in operation 2350), the cleaning device 1 according to an embodiment may control the door driver 260 to close the dust collecting bin door 19 (in operation 2360).

For example, the docking station 200 may determine to end the discharge operation upon a discharge time elapsing after the start of the discharge operation. Also, depending on the embodiment, even before the elapse of the discharge time, the docking station 200 may determine to end the discharge operation when a stop command is input or the vacuum cleaner 100 is separated from the docking station 200. Also, depending on the embodiment, the docking station 200 may determine to end the discharge operation when the capacity level of the dust collecting bin 15 is less than a predetermined value (a second set value).

Also, depending on the embodiment, upon determining to end the discharge operation, the docking station 200 may transmit to the vacuum cleaner 100 a control command for the first suction device 150 of the vacuum cleaner 100 to rotate at a high speed.

Figure 24:
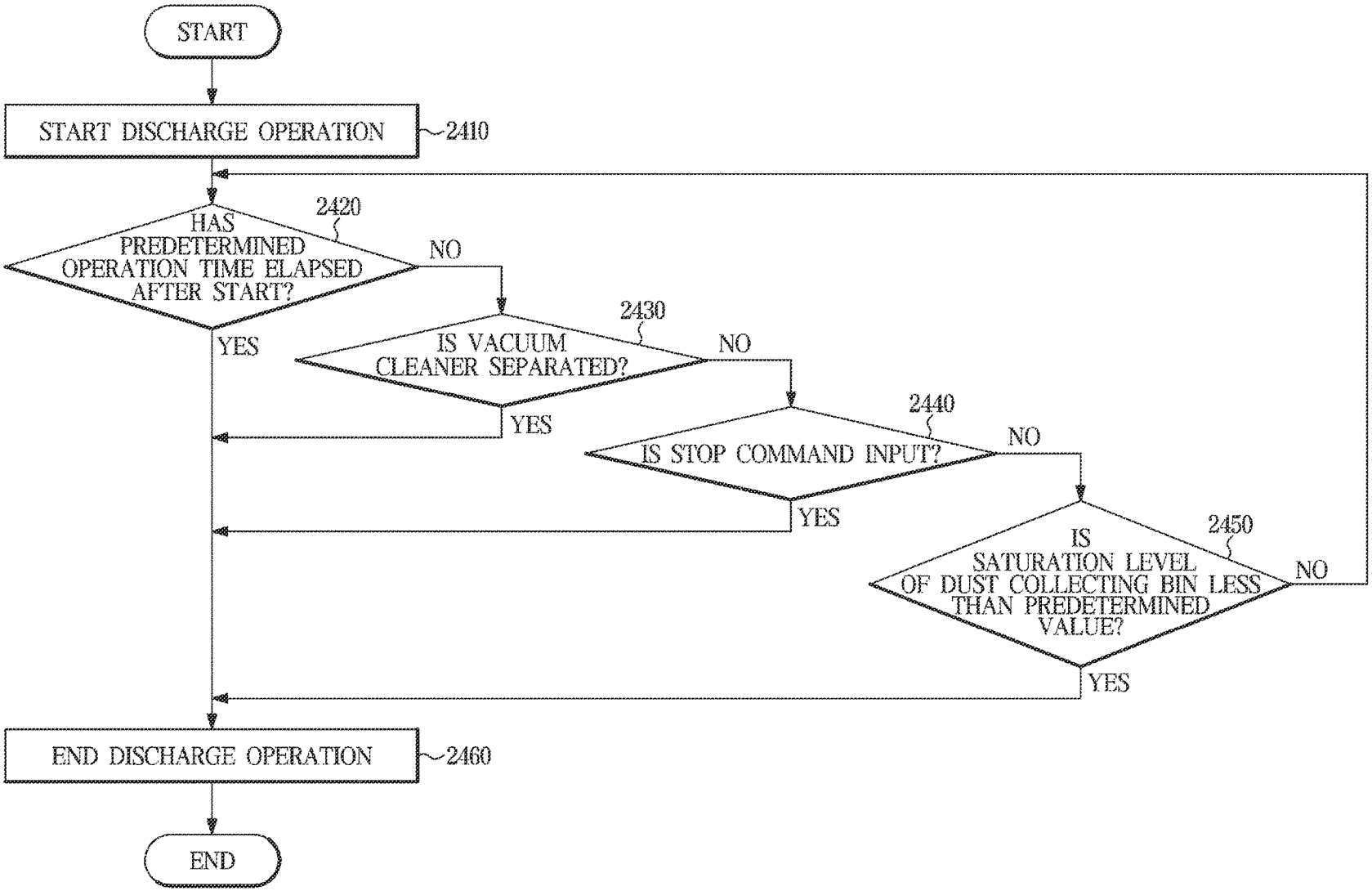
FIG. 24 is a flowchart of ending the discharge operation in the control method of the cleaning device according to an embodiment of the disclosure.

FIG. 24 is a flowchart of ending the discharge operation in the control method of the cleaning device 1 according to an embodiment of the disclosure.

Referring to FIG. 24, the cleaning device 1 according to an embodiment may start the discharge operation (in operation 2410) and may, upon a predetermined operation time elapsing (YES in operation 2420), end the discharge operation (in operation 2460). That is, the cleaning device 1 may perform the discharge operation for the predetermined operation time.

However, even when the predetermined operation time has not elapsed (NO in operation 2420), the cleaning device 1 may end the discharge operation (2460) in the case in which the vacuum cleaner 100 is separated from the docking station 200 (YES in operation 2430), a stop command relating to the discharge operation is received from a user (YES in operation 2440), or the capacity level of the dust collecting bin 15 is less than a predetermined value (YES in operation 2450).

Figure 25:
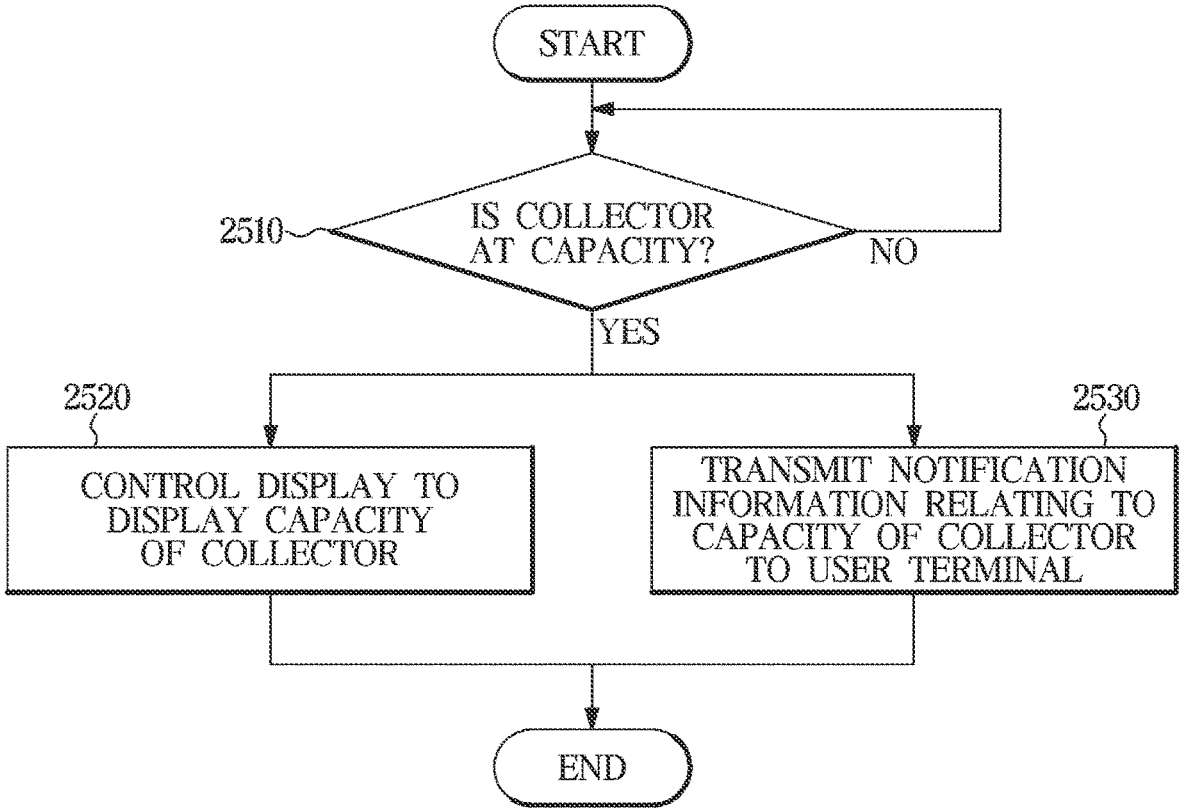
FIG. 25 is a flowchart of a case in which the collector is filled to capacity in the control method of the cleaning device according to an embodiment of the disclosure.

FIG. 25 is a flowchart of a case in which the collector 290 is filled to capacity in the control method of the cleaning device 1 according to an embodiment of the disclosure.

Referring to FIG. 25, the cleaning device 1 according to an embodiment may, in the case in which the collector 290 is filled to capacity (YES in operation 2510), control the display 280 to display the capacity of the collector 290 (in operation 2520).

The cleaning device 1 according to an embodiment may determine whether the collector 290 is filled to capacity based on an output of the collector sensor 215 and may, in the case in which the collector 290 is at capacity, control the display 280 to display the capacity of the collector 290.

For example, the docking station 200 may control the display 280 to output first light (e.g., blue light) in the case in which the collector 290 is not at capacity. Also, the docking station 200 may control the display 280 to output second light (e.g., red light) in the case in which the collector 290 is filled to capacity and may control the display 280 to continue outputting the second light (e.g., red light) until the dust bag 293 of the collector 290 is replaced.

Also, in the case in which the collector 290 is filled to capacity (YES in operation 2510), the cleaning device 1 may transmit notification information relating to the capacity of the collector 290 to the user terminal 300 (in operation 2530).

That is, in the case in which the collector 290 is at capacity, the cleaning device 1 may control the communication interface 220 to transmit notification information 1300 relating to the capacity of the collector 290 to the user terminal 300. In this way, the user terminal 300 may display the notification information 1300 relating to the capacity of the collector 290.

In this way, the cleaning device 1 may inform the user of a situation in which the collector 290 is filled to capacity and thus foreign matter is not able to be normally discharged from inside the dust collecting bin 15 and may notify the user to replace the dust bag 293 of the collector 290.

Meanwhile, the embodiments disclosed herein may be implemented in the form of a recording medium that stores computer-executable instructions. The instructions may be stored in the form of a program code, and when executed by a processor, the instructions may generate a program module and perform operations of the embodiments disclosed herein. The recording medium may be implemented as a computer-readable recording medium.

The computer-readable recording medium may include all types of recording media in which computer-decodable instructions are stored. Examples of the computer-readable recording medium may include a read-only memory (ROM), a RAM, a magnetic tape, a magnetic disk, a flash memory, and an optical data storage.

While the disclosure has been shown and described with reference to various embodiments thereof, it will be understood by those skilled in the art that various changes in form and details may be made therein without departing from the spirit and scope of the disclosure as defined by the appended claims and their equivalents.

The invention claimed is:

1. A cleaning device comprising:

a vacuum cleaner including a dust collecting bin; and a docking station capable of connecting with the vacuum cleaner, wherein the docking station is configured to:

electrically connect to a charging terminal of the vacuum cleaner in response to the vacuum cleaner being coupled to the docking station, open or close a dust collecting bin door disposed at a lower portion of the dust collecting bin, move air from the dust collecting bin into the docking station, and collect foreign matter such that the foreign matter moves with the air, wherein the docking station includes a controller configured to:

supply a first suctioning air flow to the dust collecting bin, perform a discharge operation in response to the dust collecting bin door being opened, control the docking station to periodically change a suction force of the first suctioning air flow while performing the discharge operation, and close the dust collecting bin door in response to an end of the discharge operation, wherein the docking station further includes a communication interface, wherein the controller is further configured to:

control the communication interface to transmit, to the vacuum cleaner, a control command for a cleaner suction device of the vacuum cleaner to sup-ply a second suctioning air flow while the discharge operation is performed, and control the communication interface to transmit, to the vacuum cleaner, a control command for the cleaner suction device to continuously operate while the docking station periodically changes the suction force, and wherein the first suctioning air flow supplied by the docking station moves in a direction opposite to the second suctioning air flow supplied by the cleaner suction device of the vacuum cleaner.

2. The cleaning device of claim 1, wherein the controller is further configured to control the docking station to periodically change a suction force of the first suctioning air flow while performing the discharge operation.

3. The cleaning device of claim 2, wherein the controller is further configured to control the docking station to periodically repeat turning on and off the first suctioning air flow.

4. The cleaning device of claim 2, wherein the controller is further configured to control the docking station to periodically change a rotational speed of a suction motor supplying the first suctioning air flow.

5. The cleaning device of claim 1, wherein the controller is further configured to control the communication interface to transmit to the vacuum cleaner a control command for the cleaner suction device to operate in response to a predetermined amount of time elapsing from a start of the discharge operation.

6. The cleaning device of claim 1, wherein the controller is further configured to control the communication interface to transmit to the vacuum cleaner a control command for the cleaner suction device to continuously operate for a predetermined amount of time before an end of the discharge operation.

7. The cleaning device of claim 1, wherein the controller is further configured to:

control the docking station to continuously supply the first suctioning air flow to the dust collecting bin while performing the discharge operation, and control the communication interface to transmit to the vacuum cleaner a control command for a suction force of the second suctioning air flow of the cleaner suction device to be periodically changed while the docking station continuously supplies the first suctioning air flow to the dust collecting bin.

8. The cleaning device of claim 1, wherein the controller is further configured to control the communication interface to transmit a control command to the vacuum cleaner while controlling the docking station to supply the first suctioning air flow such that an operation of the docking station supplying the first suctioning air flow and an operation of the cleaner suction device supplying the second suctioning air flow alternate with respect to each other while the discharge operation is performed.

9. The cleaning device of claim 1, wherein the docking station further includes a dust collecting bin sensor configured to detect a capacity level of the dust collecting bin, and wherein the controller is further configured to control the docking station to start the discharge operation in response to the capacity level of the dust collecting bin being determined as a first set value or more based on an output of the dust collecting bin sensor in a state in which the vacuum cleaner is coupled to the docking station.

10. The cleaning device of claim 9, wherein the controller is further configured to control the docking station to end the discharge operation in response to the capacity level of the dust collecting bin being determined as less than a second set value based on an output of the dust collecting bin sensor.

11. The cleaning device of claim 1, wherein the controller is further configured to control the docking station to start the discharge operation in response to an input for starting the discharge operation being received from a terminal through the communication interface in a state in which the vacuum cleaner is coupled to the docking station.

12. The cleaning device of claim 1, wherein the dust collecting bin includes a fixer configured to, in response to being pressed by an external force, allow a portion of the dust collecting bin door to be detached from the dust collecting bin such that the dust collecting bin is in an open state, wherein the docking station further includes an opener configured to press the fixer to make the dust collecting bin open according to an input, and wherein the controller is further configured to control the docking station to start the discharge operation in response to the opener being disposed at a position pressing the fixer in a state in which the vacuum cleaner is coupled to the docking station.

13. The cleaning device of claim 1, wherein the vacuum cleaner further includes a battery, wherein the docking station further includes a charging terminal, and wherein the charging terminal of the vacuum cleaner comes into contact with the charging terminal of the docking station when the vacuum cleaner connects with the docking station.

14. The cleaning device of claim 13, wherein the battery of the vacuum cleaner is charged based on whether the discharge operation is being performed.

15. The cleaning device of claim 14, wherein battery charge state information is transmitted to the docking station in response to the vacuum cleaner connecting with the docking station.

16. A method of controlling a cleaning device including a vacuum cleaner and a docking station capable of connecting with the vacuum cleaner, the docking station including a charger configured to be electrically connected to a charging terminal of the vacuum cleaner in response to the vacuum cleaner being coupled to the docking station, the docking station being configured to move air from a dust collecting bin of the vacuum cleaner into the docking station, the method comprising:

opening, by the docking station, a dust collecting bin door disposed at a lower portion of the dust collecting bin in response to the charging terminal of the vacuum cleaner being electrically connected to the charger;

controlling, by the docking station, to supply a first suctioning air flow to the dust collecting bin and perform a discharge operation in response to the dust collecting bin door being opened;

controlling, by the docking station, to periodically change a suction force of the first suctioning air flow while performing the discharge operation; and closing, by the docking station, the dust collecting bin door in response to an end of the discharge operation, wherein the docking station further includes a communication interface, wherein the method further comprises:

transmitting, by the docking station via the communication interface to the vacuum cleaner, a control command for a cleaner suction device of the vacuum cleaner to supply a second suctioning air flow while the discharge operation is performed; and transmitting, by the docking station via the communication interface to the vacuum cleaner, a control command for the cleaner suction device to continuously operate while the docking station periodically changes the suction force, and wherein the first suctioning air flow supplied by the docking station moves in a direction opposite to the second suctioning air flow supplied by the cleaner suction device of the vacuum cleaner.

17. The cleaning device of claim 1, wherein the first suctioning air flow supplied by the docking station is formed to flow in a downward direction from the dust collecting bin, and wherein the second suctioning air flow supplied by the cleaner suction device of the vacuum cleaner is formed to flow in an upward direction in the dust collecting bin and changing direction to flow through an outlet of a filter housing of the vacuum cleaner.

18. The cleaning device of claim 1, wherein the dust collecting bin door is closed by the second suctioning air flow.

19. A cleaning device comprising:

a vacuum cleaner including a dust collecting bin; and a docking station capable of connecting with the vacuum cleaner, wherein the docking station is configured to:

electrically connect to a charging terminal of the vacuum cleaner is response to the vacuum cleaner being coupled to the docking station, open or close a dust collecting bin door disposed at a lower portion of the dust collecting bin, move air from the dust collecting bin into the docking station, and collect foreign matter such that the foreign matter moves with the air, wherein the docking station includes a controller configured to:

supply a first suctioning air flow to the dust collecting bin, perform a discharge operation in response to the dust collecting bin door being opened, and close the dust collecting bin door in response to an end of the discharge operation, wherein the docking station further includes a communication interface, wherein the controller is further configured to:

control the communication interface to transmit, to the vacuum cleaner, a control command for a cleaner suction device of the vacuum cleaner to supply a second suctioning air flow while the discharge operation is performed, and control the communication interface to transmit, to the vacuum cleaner, a control command while controlling the docking station to supply the first suctioning air flow such that an operation of the docking station supplying the first suctioning air flow and an operation of the cleaner suction device supplying the second suctioning air flow alternate with respect to each other while the discharge operation is performed, and wherein the first suctioning air flow supplied by the docking station moves in a direction opposite to the second suctioning air flow supplied by the cleaner suction device of the vacuum cleaner.

20. A method of controlling a cleaning device including a vacuum cleaner and a docking station capable of connecting with the vacuum cleaner, the docking station including a charger configured to be electrically connected to a charging terminal of the vacuum cleaner in response to the vacuum cleaner being coupled to the docking station, the docking station being configured to move air from a dust collecting bin of the vacuum cleaner into the docking station, the method comprising:

opening, by the docking station, a dust collecting bin door disposed at a lower portion of the dust collecting bin in response to the charging terminal of the vacuum cleaner being electrically connected to the charger;

controlling, by the docking station, to supply a first suctioning air flow to the dust collecting bin and perform a discharge operation in response to the dust collecting bin door being opened; and closing, by the docking station, the dust collecting bin door in response to an end of the discharge operation, wherein the docking station further includes a communication interface, wherein the method further comprises:

transmitting, by the docking station via the communication interface to the vacuum cleaner, a control command for a cleaner suction device of the vacuum cleaner to supply a second suctioning air flow while the discharge operation is performed; and transmitting, by the docking station via the communication interface to the vacuum cleaner, a control command while controlling the docking station to supply the first suctioning air flow such that an operation of the docking station supplying the first suctioning air flow and an operation of the cleaner suction device supplying the second suctioning air flow alternate with respect to each other while the discharge operation is performed, and wherein the first suctioning air flow supplied by the docking station moves in a direction opposite to the second suctioning air flow supplied by the cleaner suction device of the vacuum cleaner.

* * * * *